US005652985A

United States Patent [19]

Wilkinson et al.

[11] Patent Number: 5,652,985

[45] Date of Patent: Aug. 5, 1997

[54] SELF-ADJUSTING PRESSURE RELIEF SUPPORT SYSTEM AND METHODOLOGY

[75] Inventors: John W. Wilkinson, Bennington, Vt.; Richard W. Raburn, Simpsonville; Thomas S. Hargest, Charleston, both of S.C.

[73] Assignee: Span-America Medical Systems, Inc., Greenville, S.C.

[21] Appl. No.: 253,982

[22] Filed: Jun. 3, 1994

[51] Int. Cl.[6] ..... A47C 27/08; A47C 27/10; A61G 7/057

[52] U.S. Cl. ..... 5/710; 5/706; 5/665; 5/654; 5/655.3; 5/909; 297/452.41; 297/DIG. 3

[58] Field of Search ..... 5/453, 455, 448, 5/451, 456, 449, 654, 909, 690–740, 655.3; 297/452.41, DIG. 3

[56] References Cited

U.S. PATENT DOCUMENTS

| | | | |
|---|---|---|---|
| D. 307,688 | 5/1990 | Schaefer . | |
| D. 307,689 | 5/1990 | Schaefer . | |
| D. 307,690 | 5/1990 | Raburn . | |
| D. 322,907 | 1/1992 | Raburn . | |
| D. 336,400 | 6/1993 | Mitchell et al. . | |
| 2,072,570 | 3/1937 | Smith . | |
| 3,428,973 | 2/1969 | Hargest et al. . | |
| 3,866,604 | 2/1975 | Hargest . | |
| 3,999,235 | 12/1976 | Moullura | 5/451 |
| 4,193,149 | 3/1980 | Welch . | |
| 4,603,445 | 8/1986 | Spann . | |
| 4,655,505 | 4/1987 | Kasmiwamura et al. . | |
| 4,679,264 | 7/1987 | Mollura . | |
| 4,686,725 | 8/1987 | Mitchell . | |
| 4,700,447 | 10/1987 | Spann . | |
| 4,711,275 | 12/1987 | Ford et al. . | |
| 4,797,962 | 1/1989 | Goode . | |
| 4,843,663 | 7/1989 | Horvat et al. . | |
| 4,862,538 | 9/1989 | Spann et al. . | |
| 4,901,387 | 2/1990 | Luke . | |
| 4,914,760 | 4/1990 | Hargest et al. . | |
| 4,942,635 | 7/1990 | Hargeset et al. . | |
| 4,967,431 | 11/1990 | Hargest et al. . | |
| 4,995,124 | 2/1991 | Wridge, Jr. et al. . | |
| 5,007,124 | 4/1991 | Raburn et al. . | |
| 5,025,519 | 6/1991 | Spann et al. . | |
| 5,029,352 | 7/1991 | Hargest et al. . | |
| 5,036,559 | 8/1991 | Hargest . | |
| 5,070,560 | 12/1991 | Wilkinson . | |
| 5,142,717 | 9/1992 | Everard et al. . | |
| 5,252,278 | 10/1993 | Spann et al. . | |
| 5,446,933 | 9/1995 | Gabelhouse | 5/451 |

FOREIGN PATENT DOCUMENTS

| | | | |
|---|---|---|---|
| 2073424 | 1/1994 | Canada | 5/448 |

*Primary Examiner*—Alexander Grosz
*Attorney, Agent, or Firm*—Dority & Manning

[57] ABSTRACT

A pressure relief support system utilizes a self-adjusting approach to maintaining generally constant pressure in fluid support bladders. A constant force, such as from a constant force linear spring or from a counterweight system, is applied directly to a fluid support bladder or to a reservoir in fluid communication with such bladder. Plural self-adjusting arrangements may be provided in a single device for fabricating a support body with sectionalized support. Such arrangements may be incorporated into mattress support systems or into seating arrangements or other alternative uses. By appropriately selecting system components, such as the amount of the constant force applied, the original volume of fluid to which the force is applied, and the reservoir size, pressure dispersion for a patient or supported object of any type may be controlled at a predetermined generally constant point. By utilizing the potential energy of a constant force linear spring or equivalent arrangement, a self-adjusting system and methodology is provided which does not require any form of electronic control system for receiving sensory feedback or for operating pressure pumps or valving systems responsive to any such feedback.

155 Claims, 17 Drawing Sheets

SELF-ADJUSTING PRESSURE RELIEF SUPPORT SYSTEM AND METHODOLOGY

BACKGROUND OF THE INVENTION

This invention generally relates to the field of pressure relief and more particularly to self-adjusting pressure relief systems and to corresponding methodologies.

Particularly in the field of healthcare, there has been a long felt and profound need to provide pressure relief for immobile or otherwise confined patients. For a tremendous variety of reasons, many patients must withstand long periods of bed rest or other forms of confinement, such as use of a wheelchair or other accommodating but restrictive support arrangement. In those instances, there is a tremendous risk that exposures to excess pressures, or longer term exposures to relatively lower pressure levels, can result in painful and even dangerous sores and other conditions.

Literally an entire segment of the healthcare industry is directed to the study and treatment of various tissue traumas, such as decubitus ulcers. Tissue damage can be monitored and rated, with progressively higher ratings warranting more involved treatment approaches. Consequently, the healthcare industry perceives and evaluates treatment options on the basis of their ability to address conditions at such different stages or ratings.

Some patient conditions to be addressed are not initially caused by excess pressure damage. For example, burn patients often have critical and even life threatening tissue care needs, but which did not originate from an excess pressure condition. Again, the initial condition of the patient is also ratable, which tends to dictate the measure of response.

Still further patients or others may have special needs. For example, injured patients, such as hip fractures or the like, may require special support care during a recovery period. Still other patients may have more long term specialized needs, such as amputees, who may have pressure sensitive areas and pressure points not accounted for by a support arrangement designed for a patient having weight dispersed over all limbs.

Literally scores of products, based on various technologies, have sought to address the constantly ongoing problem referenced above. As addressing the higher rated problems is, in general, technically more difficult, the costs of available treatments tend to rise in proportion with the rating magnitude of the problem. Generally speaking, while cost containment has always been of concern in the healthcare industry, it has recently become a much more significant issue. As a net result of various forces acting with a goal of reducing costs, it is possible that the treatment needs (whether preventative or curative) of specific patients may run the risk of being inappropriately or even inadequately addressed.

Over time, as in any sort of industry, efforts have been made to simultaneously improve both quality (in the sense of product performance) and price. Typically, it can be difficult to simultaneously achieve both such goals, especially whenever product performance improvement comes at the expense of more entailed and sophisticated technologies. In addition, it is frequently the case that achieving top performance (i.e., optimized pressure relief or dispersion) is highly challenging, regardless of the available technology, at any cost. One contributing factor is the tremendous variation in patient needs which must be potentially met by a particular product (i.e., support system or methodology).

Typically, various support systems have made use of resilient support bodies, such as strips or blocks of foam, or some other support bladder containing a specific fluid. Mattress technologies, in general, have often made use of other resilient support media, such as springs, slats, or various support fillers, such as ticking. Different gases, often such as air, or various liquids have been used, including relatively viscous liquids, such as gels. In some instances, combinations of the above various technologies have been used.

As an effort to provide various cost effective designs applicable in different circumstances, there has generally been a progression in the sophistication of various products. For example, a repeating pattern such as convolutions may be readily formed in a resilient foam product for providing a resilient mattress supplement. See, for example, U.S. Pat. No. 4,686,725 entitled "Mattress Cushion with Securement Feature." While various repeating surface patterns are readily produced, more complicated repeating surface patterns have been provided in efforts to improve product performance over convoluted pads. See, for example, U.S. Pat. No. 4,901,387 entitled "Mattress Overlay with Individual Foam Springs."

One aspect of support systems, especially concerning those for use with recumbent patients, is that they are faced with distinctly different loading requirements along the longitudinal axis thereof. In other words, certain body areas of a patient will be heavier than others, thereby generally requiring greater support in such longitudinal areas if pressure relief is to be optimized.

As a result, various support pads have Sought to provide sectionalized support. One such resilient foam pad making use of a uniform patterned surface, though with differential resilient support responsive to different loads, is U.S. Pat. No. 5,007,124 entitled "Support Pad with Uniform Patterned Surface."

As foam surface patterns become more sophisticated, there is a corresponding increase in the difficulty of producing such articles. One example of a three section foam mattress is U.S. Pat. No. Des. D336,400, entitled "Foam Mattress Pad." Another example of a still more complicated foam mattress surface, typically requiring a computer controlled cutting machine for production, is U.S. Pat. No. 4,862,538, entitled "Multi-Section Mattress Overlay for Systemized Pressure Dispersion."

Still further examples of various resilient foam support pads and the like, and certain aspects of manufacture thereof, are Shown by U.S. Pat. Nos. 4,603,445; 4,700,447; Des. D307,688; Des. D307,689; Des. D307,690; 5,025,519; Des. D322,907; and 5,252,278. Generally speaking, as support surface designs become more entailed, they become more difficult and more expensive to produce. At the same time, regardless of the manufacturing cost, they provide a generally static or preset response to loading changes, i.e., changes in the weight of the patient being supported in a specific region of the pad. Such variations may occur due to the variations among patients, or simply to the movement of an individual patient.

Other technologies involving fluid filled support bladders of various sorts may be incorporated into different types of systems regarded as either static or dynamic. Typically, what is meant by a static system is that the fluid level within a particular support chamber is sealed or otherwise relatively unchanged (or constantly replenished against losses). The pressure dispersion offered with such a system is thus, in at least one sense, analogous to the preestablished response expected with fixed resilient foam systems. However, it will be apparent to those of ordinary skill in the art that a fluid filled chamber approach, even in a static condition, would provide hydraulic fluid flow performance not found in a resilient foam system. Of course, the net pressure relief performance of any system or methodology encompasses various factors.

One example of a pressure relief support system utilizing fluid filled chambers is shown by U.S. Pat. No. 5,070,560, entitled "Pressure Relief Support System for a Mattress." In such patent, sealed longitudinal air cylinders are provided in the shape of a mattress, otherwise having various transverse slats and/or foam strips or members. Such a support system offers air dispersion pressure treatment in a static design which avoids the relative extremely high cost and other negative factors often associated with active air bed systems.

Highest rated pressure relief support systems typically involve beds having a plurality of fluid filled chambers, the internal pressures of which are maintained at a constant pressure by a relatively higher technology dynamic system approach. Specifically, each fluid filled support element may be associated with its own control valve, alternately permitting ingress and egress of fluid. Various pressure sensitive detection devices typically may be utilized in a feedback control system for determining that an excess pressure condition (or a subpressure condition) exists. Thereafter, the control technology is operative for bleeding off excess pressure by selected valving operation (such as dumping excess fluid into a reservoir arrangement) or for actively pumping in additionally needed fluid.

As such, the above higher technology systems require various motors, pumps, valving systems, sensory feedback arrangements, and control systems for all the foregoing. Due to their complicated construction and design, such beds are typically very expensive as to initial purchase or rental cost. They can also be complicated and expensive to maintain due to the prospect of frequent failure of numerous moving mechanical parts, and due to the extensive training which an operator or maintenance person would be required to undergo.

Also, there is the prospect of highly undesired heat transfer to a patient, due to operation to the above-referenced motors, pumps and other systems. Still further, the construction and design of such overall systems often require specialized bed frames not otherwise usable with typical mattresses.

The disclosures of the above-referenced United States Patents are fully incorporated herein by reference, all of which such Patents are commonly assigned with the subject application.

SUMMARY OF THE INVENTION

The present invention is intended to recognize and address various of the foregoing problems, and others, concerning pressure relief systems and methodologies. Thus, broadly speaking, a principal object of this invention is improved pressure relief methodologies and systems. More particularly, a main concern is improved self-adjusting technology without requiring the expense and complexity of typical higher technology prior systems.

It is, therefore, another particular object of the present invention to provide apparatus and methodology which achieves the performance advantages of a dynamic fluid-based system, but at the same time without requiring the complicated and expensive constructions and designs typical of previous systems.

It is thus another general object of the present invention to provide a self-adjusting system which is capable of relying on the use of potential energy. Hence, a more particular object is to provide such an improved system and methodology which does not require the use of external energy. More specifically, it is a present object to avoid the need for sensory feedback control systems, and/or systems for controlling pump and valving systems, but while also still providing a dynamic fluid-based system.

Another present general object is to provide a fully self-adjusting pressure relief system which optimizes pressure dispersion, while still using a relatively inexpensive and simple design so as to obviate the need for motors, control systems, or specialized bed frames or training associated with its use and, maintenance.

Yet another object is to provide a pressure relief support system which is self-adjusting to allow for more even body weight distribution, thereby improving the reduction of pressure on the tissue and skin of a user. At the same time, it is an object to provide a self-adjusting technology which may be customized, as desired, for different patient uses, and for different alternate uses.

More specifically, it is a present object to provide a self-adjusting pressure relief technology which is usable with virtually any type of fluid (gas, liquid, relatively viscous liquids), and which is usable in a variety of settings. Specifically, it is intended to provide such self-adjusting technology usable in both medical and commercial fields, including both mattress-related technologies and seating technologies, as well as others. In the area of medical uses, it is intended to provide a system and improved technology which is usable in space critical circumstances, such as involving X-ray, operating room, or NMR technology uses. It is intended for the present technology to be equally applicable to Critical care situations, emergency room gurneys, ambulance stretchers and medical seating systems of all types, such as wheelchairs or geriatric chairs.

It is another present object to provide a self-adjusting technology with the advantages of active (i.e., dynamic) fluid-based systems, but with such simplicity that the technology may be extended to every day consumer products, such as ergonomic chairs and car seats, as well as consumer mattress replacement systems, mattresses and mattress overlays (as would also be applicable in the medical field).

It is a still further object of the present invention to provide a technology capable of being customized to provide specialized support surfaces, such as for pregnant women, or for amputees or other persons requiring nonconventional support needs for either sitting or sleeping (i.e., bedrest).

Still further, it is a present object to provide improved technology applicable in a broad sense virtually to any circumstance of bodies in rest. For example, such technology may be incorporated into specialized pillows, such as in the case of head injuries involving swelling or other weight changes. Likewise, the present technology would be equally applicable to packaging arrangements (such as for fragile equipment) where it is desired to minimize or limit pressures associated with transfer shock or the like.

Additional objects and advantages of the invention are set forth in or will be apparent to those of ordinary skill in the art from the detailed description which follows. Also, it should be further appreciated that modifications and variations to the specifically illustrated and discussed features, steps or materials hereof may be practiced in various embodiments and uses of this invention without departing from the spirit and scope thereof, by virtue of present reference thereto. Such variations may include, but are not limited to, substitution of equivalent means and features, materials or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, steps, or elements, or their equivalents (including combinations of features or steps or configurations thereof not expressly shown in the figures or stated in the detailed description). Also, it is to be understood that various features from one embodiment; as illustrated, discussed or suggested, may be combined with or substituted for features of other disclosed or suggested embodiments, within the spirit and scope of the present invention.

One exemplary embodiment of the present invention relates to a self-adjusting pressure relief patient support apparatus. Such apparatus may comprise a main support body and a constant force fluid reservoir means. Such main support body is provided for receiving a patient thereon, and has at least one adjustable fluid support bladder with fluid therein. Multiple fluid support bladders may be used in additional embodiments and various forms of fluids may be practiced throughout all such embodiments.

The above-referenced constant force fluid reservoir means is preferably provided in fluid communication with the fluid support bladder. Such fluid reservoir means is operative for automatically adjusting the bladder using potential energy (as opposed to requiring any external energy or sensory feedback or pump/valve control systems). With such an arrangement utilizing potential energy, the invention is able to maintain a generally constant predetermined internal pressure in such bladder responsive to changing patient loading on the main support body.

The foregoing system and corresponding methodology is equally applicable to various sectionalized support arrangements with multiple independently acting support sections, as further described herein.

Another present exemplary embodiment concerns a self-adjusting pressure relief patient support apparatus having a main support body and a constant force response means. Such main support body may be provided as discussed above, or as in additional embodiments discussed throughout the present application.

The above-referenced constant force response means preferably is physically operative with the fluid support bladder and functions for automatically adjusting such bladder, again using potential energy. With such arrangement, the subject invention is able to maintain a generally constant predetermined internal pressure in the bladder responsive to changing patient loading on the main support body, without requiring sensory feedback or control systems for operating pressure pumps or valving systems.

In the forgoing embodiments, various alternative provisions may be made for using potential energy, such as incorporating constant force springs (such as constant force linear springs), counterweight arrangements, and use of various resilient members, all as otherwise discussed and described herein.

Yet another construction comprising a presently exemplary embodiment concerns a mattress overlay for providing optimized interface pressure dispersion for a patient received thereon without use of an external power source and without requiring any electronic control system for receiving sensory feedback and operating pressure pumps or valving systems responsive thereto. Such a mattress overlay preferably comprises a main support body, a plurality of air hoses, air reservoirs, and constant force springs, and at least four reservoir actuation means.

Such main support body is provided for receiving a patient thereon, and has at least four elongated air chambers arranged generally in parallel therein with each chamber having a respective air port. The body further has a resilient support layer received over the air chambers and on which a patient is received.

The plurality of air hoses are respectively connected in air sealed relationship with each of the respective air ports.

The plurality of air reservoirs are respectively connected in air sealed relationship with each of the respective air ports. With such an arrangement, at least four independently acting pressure relief devices are formed by the resulting respective grouping of an air chamber, air hose and air reservoir in air sealed relationship with each such grouping having an initially predetermined amount of air therein movable within the air sealed grouping so as to permit the establishment of air pressure equilibrium within such grouping.

At least one constant force spring is respectively associated with each air reservoir.

One each of the at least four reservoir actuation means, are associated with each respective independently acting pressure relief device. Each such means is respectively operative for applying the potential energy of a corresponding constant force spring to its respective air reservoir so that changes in patient loading applied to each respective air chamber are automatically compensated within a predetermined range by use of the potential energy of its corresponding constant force spring. With the foregoing, air pressure within such grouping is automatically maintained within a range predetermined for optimizing dispersion of patient interface pressures with said mattress overlay, without requiring sensory feedback on control systems.

Still further aspects of the present invention relate to various embodiments concerning a self-adjusting component for use with a fluid chamber in a pressure relief patient support system. An exemplary embodiment of such component may comprise a fluid reservoir, fluid passageway means, reservoir actuation means, and constant force actuation means.

The fluid reservoir is provided with fluid therein and a fluid port.

The fluid passageway means are for interconnecting such reservoir fluid port in sealed fluid communication with the fluid chamber of a pressure relief patient support system.

The reservoir actuation means preferably are responsive to an actuation force applied thereto for acting on the reservoir with a force tending to push fluid from the fluid reservoir into the fluid passageway means and towards a fluid chamber associated therewith.

In the above arrangement, such constant force actuation means are provided for applying a generally constant actuation force to the reservoir actuation means, so that a varying flow of fluid tending to push towards the fluid reservoir into the fluid passageway means and from a fluid chamber associated therewith due to corresponding varying patient loading applied to such patient support fluid chamber is automatically met with an opposing fluid force from the reservoir until an equilibrium fluid pressure is obtained providing a patient interface pressure coming within a predetermined range.

It is to be understood that the subject invention also relates to and encompasses corresponding methodologies, also as discussed herein. Those of ordinary skill in the art will better appreciate the features and aspects of such embodiments, methods and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Repeat use of referenced characters throughout the present specification and appended drawings is intended to represent same or analogous features, elements, or steps of the invention.

DETAILED DESCRIPTION OF THE PREFERRED EMBODIMENTS

Figure 1A:
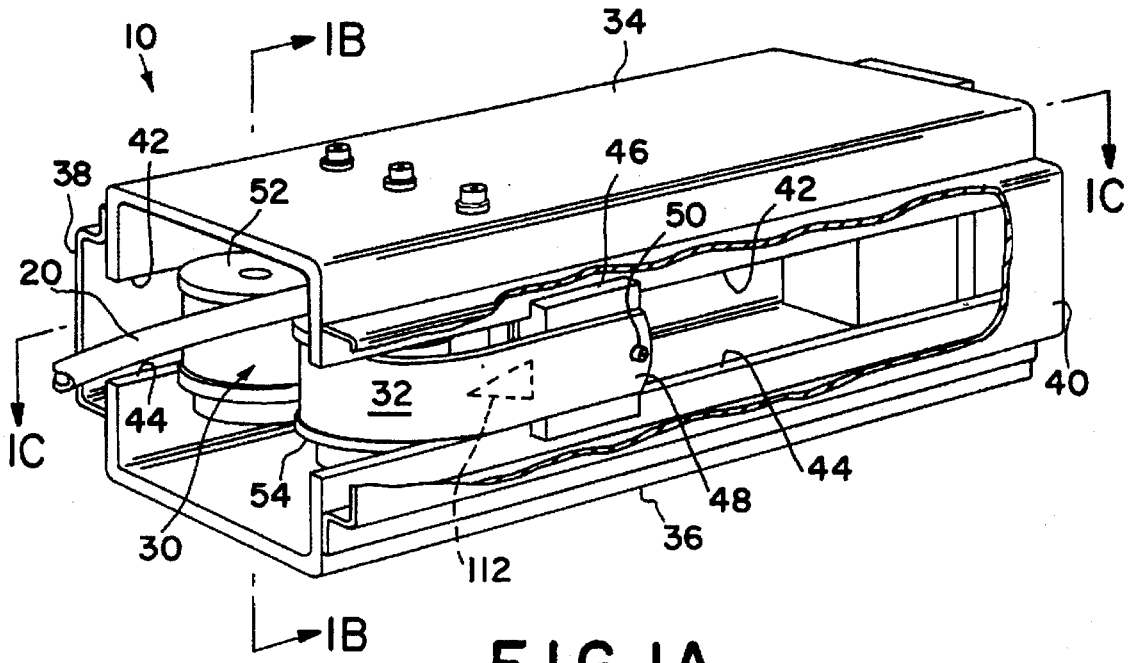
FIG. 1A is a perspective view, in partial cutaway, of a first embodiment of a reservoir operative device in accordance with the subject invention.
Figure 1B:
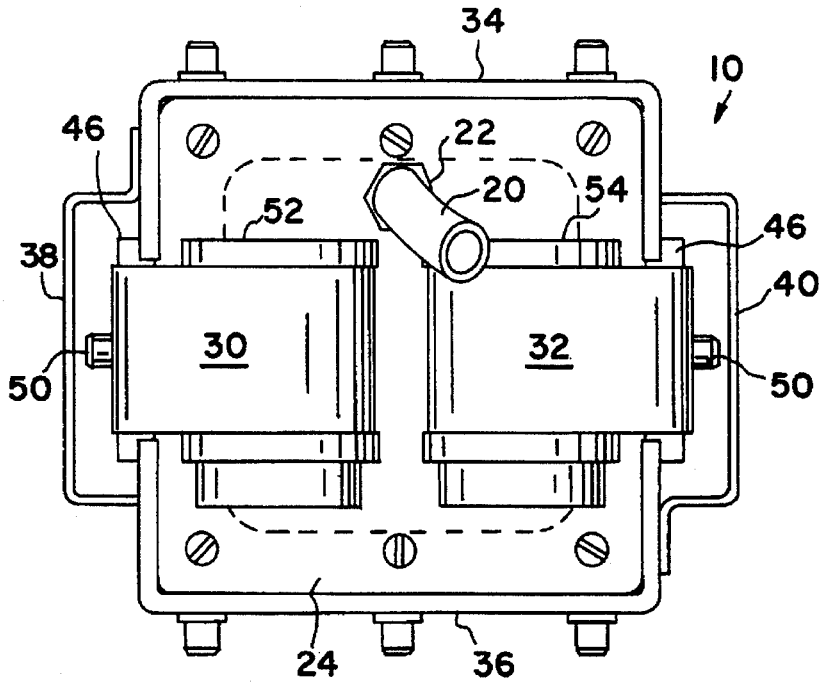
FIG. 1B is a generally end elevational view of the exemplary embodiment of present FIG. 1A, as referenced by view line 1B—1B indicated therein.
Figure 1C:
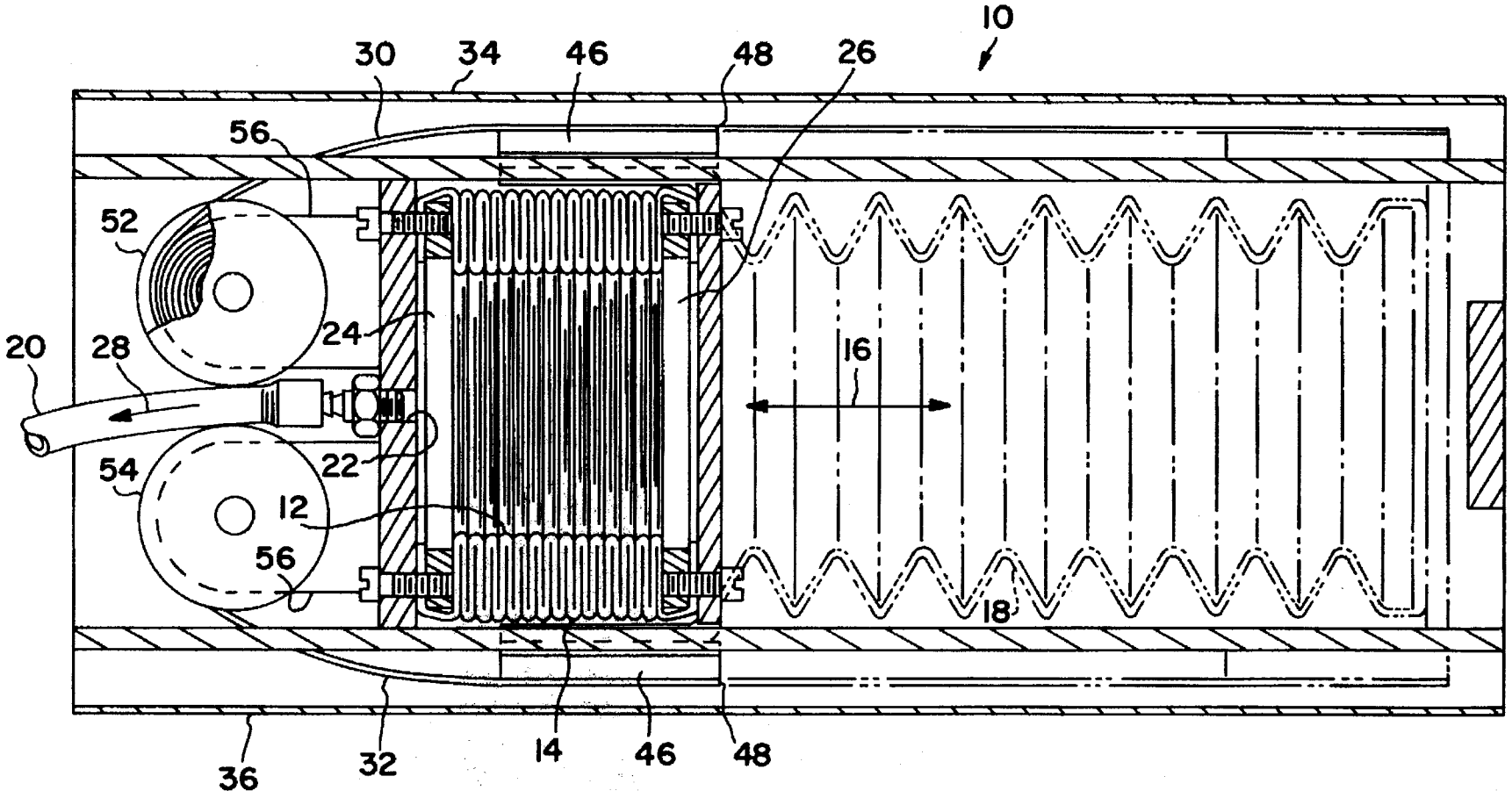
FIG. 1C is an enlarged cross-sectional view of the exemplary embodiment of present FIG. 1A, taken along the section line 1C—1C indicated therein.
Figure 1D:
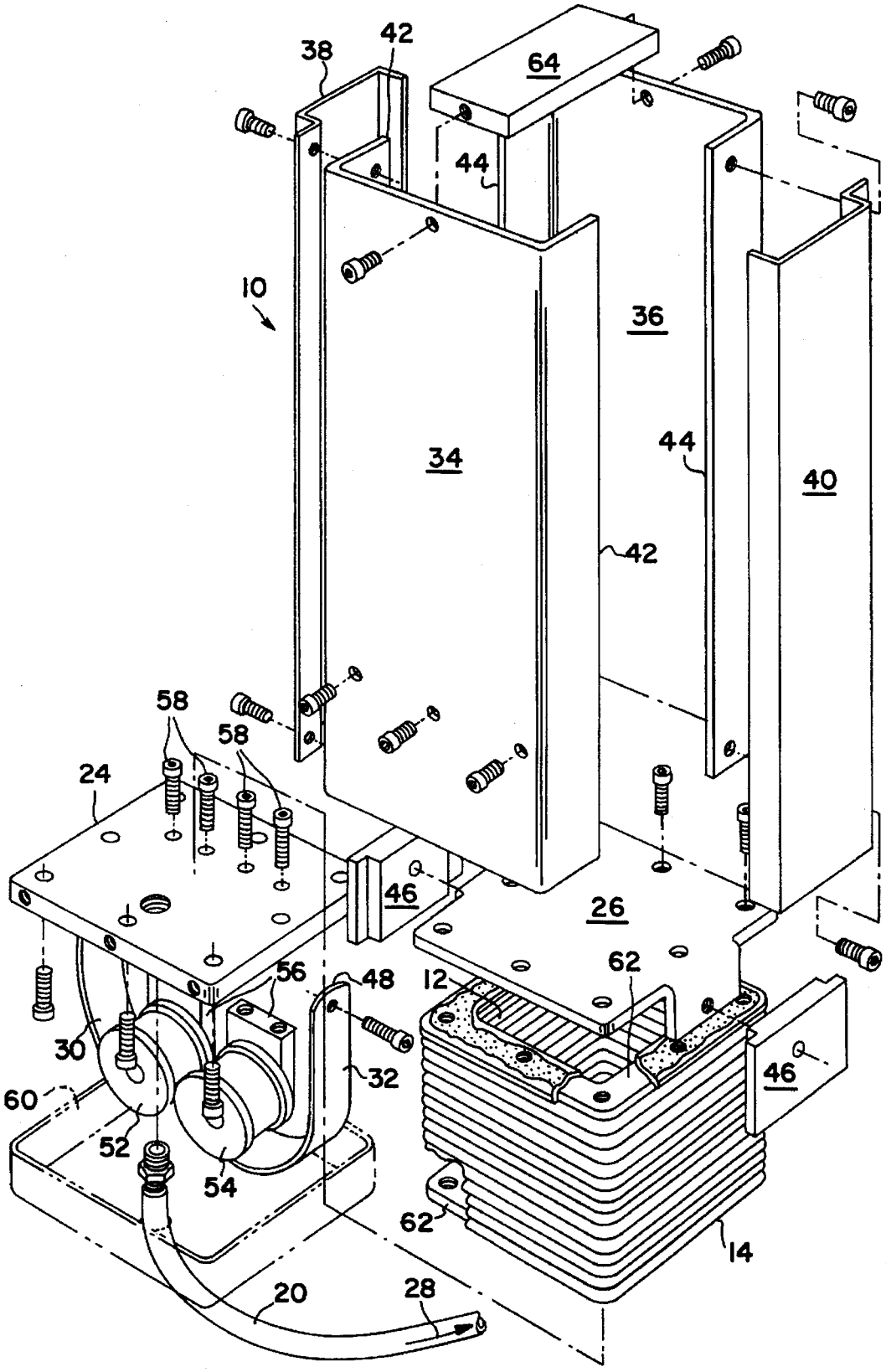
FIG. 1D is an exploded, generally perspective view of the present embodiment of FIG. 1A.

It will be readily understood by those of ordinary skill in the art that the following discussion relates to specifics solely for the purpose of explaining exemplary embodiments of the present invention, and that all such description is not intended as limiting the otherwise more broadly stated aspects hereof. In the initial set of FIGS. 1A through 1D, a self-adjusting component 10 is shown for use with a fluid chamber in a pressure relief support system. FIG. 1A illustrates a generally side perspective view thereof, while FIG. 1B shows an end elevation per view line 1B—1B of FIG. 1A, and while FIG. 1C illustrates a cross-sectional view generally along the longitudinal section line 1C—1C as indicated therein. FIG. 1D illustrates an exploded view with partial cutaway. Partial cutaway is also used in FIG. 1A for greatly clarity, as will be understood by those of ordinary skill in the art.

Certain aspects of the subject invention relate to various exemplary self-adjusting components, while other aspects of the subject invention relate to use of such components in a support system such as for supporting the human body on a bed, mattress, mattress overlay, mattress replacement device, seating arrangement, or similar.

As will be discussed below, such a support system makes use generally of a main support body having at least one adjustable fluid support bladder which is in fluid communication with constant force reservoir means, such as exemplified by component 10. Fluid reservoir means 10 generally is operative for automatically adjusting the bladder using potential energy so as to maintain a generally constant predetermined internal pressure in such bladder responsive to changing patient loading on the main support body.

More specifically (and collectively) referring to the embodiment of present FIGS. 1A through 1D, a fluid reservoir generally 12 is provided such as with a bellows arrangement 14, for receipt of fluid therein. Such fluid may comprise gaseous or liquid materials, or even relatively viscous liquid materials (such as gel), as otherwise discussed in this application.

Fluid reservoir 12 may comprise a generally longitudinal bellows 14 having pleated sidewalls such that the volume of bellows 14 varies with axial compression thereof. Such compression may occur along the axis line 16 represented in present FIG. 1C, and may involve movement of the bellows between a fully compressed condition as shown in solid lines in FIG. 1C and a fully expanded condition, as show in dotted line of the bellows embodiment 18 of FIG. 1C. It will be apparent to those of ordinary skill in the art that the volume of bellows 14 is continuously variably adjustable between the two extreme conditions represented.

Constant force fluid reservoir means 10 may further include fluid passageway means 20 for interconnecting reservoir 12 in sealed fluid communication with a support bladder (shown in later figures). Such fluid passageway means may include a fluid port (such as 22 or an equivalent opening or means of passage) otherwise associated with the reservoir 12 and an interconnecting conduit associated with such port. The conduit preferably may comprise flexible tubing, as illustrated, though bent metal tubing or other embodiments may be practiced.

Reservoir 12 may also be perceived as comprising a fluid sealable membrane adapted to be variably compressed by the action of elements pressing thereon, as discussed hereinafter. For example, at least two members preferably are integrally associated with such reservoir 12 so as to form part of the reservoir 12. Specifically, a base plate 24 and a top plate 26 (such as both made of aluminum) may be received against otherwise open ends of the preferably vinyl bellows 14 for sealing the reservoir 12. As represented by double-headed arrow 16, such end plates 24 and 26 are alternately movable in relative planar parallel movements to each other so as to variably compress the reservoir 12 therebetween depending on the degree of such parallel movement. As shown, as least one of such end plates (such as 24) is provided with a port 22 for fluid interconnection of the reservoir 12 with the fluid passageway means 20.

The foregoing end plate members, may, in essence, comprise reservoir actuation means, responsive to an actuation force applied thereto for acting on the reservoir 12 with a force tending to push fluid from such fluid reservoir 12 into the fluid passageway means 20 and towards a support bladder (not shown) in the direction of arrow 28. In such illustrated embodiment, at least one guide channel may be provided for movement of such planar elements therealong, as discussed below.

In accordance with the present invention, preferably a constant force is applied as the actuation force to end plates 24 and/or especially 26. In the present exemplary embodiment of device 10, a pair of constant force linear springs 30 and 32 may be used. Such components are well known stock items available to those of ordinary skill in the art, and available with many different strength and cycle characteristics, as also well known without further discussion.

More particularly, aluminum or Lexan sidecovers 34 and 36 may be provided for establishing a basic structure by which device 10 may be assembled. Of course, alternative embodiments may be utilized. Attached to such sidecovers 34 and 36 are exemplary spring covers 38 and 40 (such as of aluminum). As illustrated particularly by cutaway of element 40 in FIG. 1A, the spaced inside edges 42 and 44 of opposing sidecovers 34 and 36 form shoulders against which a slide block 46 or the like may be slidably received. Such slide block may comprise a low friction plastic such as an ultra high molecular weight material.

As shown, distal end 48 of each constant force linear spring 30 and 32 may be secured to movable top plate 26 via the respective slide blocks 46. Such coupling may be accomplished with a variety of means, such as threaded bolts 50 or equivalents thereof, such as screws, rivets, welds, snaps, or the like. Though not discussed in detail, it will be readily apparent to those of ordinary skill in the art without further discussion that additional numerous such connecting elements may be used for holding together the remaining features of device 10, all as particularly illustrated in the exploded view of present FIG. 1D.

The pair of constant force linear springs (or, more generally, constant force springs) provided in tandem in the embodiment of device 10, are respectively supported on aluminum or like material spools 52 and 54. For example, such spools may have a spring support diameter of about two inches, and may be themselves rotatably mounted on spool supports 56, which are attachable in turn to base plate 24 with threaded bolts 58. An end cap generally 60 (FIG. 1D) may be provided for additional security that nothing will interfere with travel of springs 56.

In a further aspect of such embodiment, it is to be understood as preferred that a tapped flange 62 is received inside each end of bellows 14, for being secured to the respective end plates 24 and 26. Preferably, each such flange 62 is formed of a steel material, since generally greater stress points are involved.

Still further, a top cross member 64 may be utilized to add additional stability of the arrangement and to ensure, if needed, stop limit for the travel of bellows 14, to ensure that springs 32 and 30 are not pulled too far off of their respective spools 52 and 54. As will be generally understood by those of ordinary skill in the art, constant force linear springs 30 and 32 may typically need not be physically secured to their respective spools, other than by the grasping force achieved by several turns of springs 30 and 32 around their respective spools.

As should be readily understood by those of ordinary skill in the art, the foregoing arrangement provides constant force actuation means for providing a generally constant actuation force to the reservoir actuation means. With such an arrangement, a varying flow of fluid tending to push towards fluid reservoir 12 (the opposite direction of arrow 28) via fluid passageway means 20 and from a fluid chamber associated therewith due to corresponding varying patient loading applied to such patient support fluid chamber, is automatically met with an opposing fluid force from the reservoir 12 until an equilibrium fluid pressure is obtained. Therefore, such arrangement provides a patient interface pressure coming within a predetermined range established by the various physical characteristics and interrelationships of the device 10 and other associated factors.

In one exemplary embodiment, the overall length of sidecovers 34 and 36 may be in a range of approximately 12 to 20 inches, with bellows 14 axially expandable and collapsible relative thereto (as shown in FIG. 1C). Such bellows 14 may have a cross section transverse to the longitudinal axis 16 of about 16 square inches (i.e., four inches on each side). With such an arrangement, in accordance with present methodology, a constant force rating of approximately two pounds for each of the springs 30 and 32 can result, with appropriate initial fluid levels, in establishing and maintaining a generally constant predetermined internal pressure in an adjustable fluid support bladder associated with fluid passageway means 20. Preferably, such range of internal pressure (relative to local atmospheric pressure) may generally be between about 0.2 PSI and 0.5 PSI. In certain embodiments, a constant pressure of approximately 0.25 PSI is preferred, while in other embodiments, users may prefer a constant pressure established in a greater range of 0.2 PSI to 0.3 PSI, or in a higher range of 0.35 PSI to 0.45 PSI.

Figure 2A:
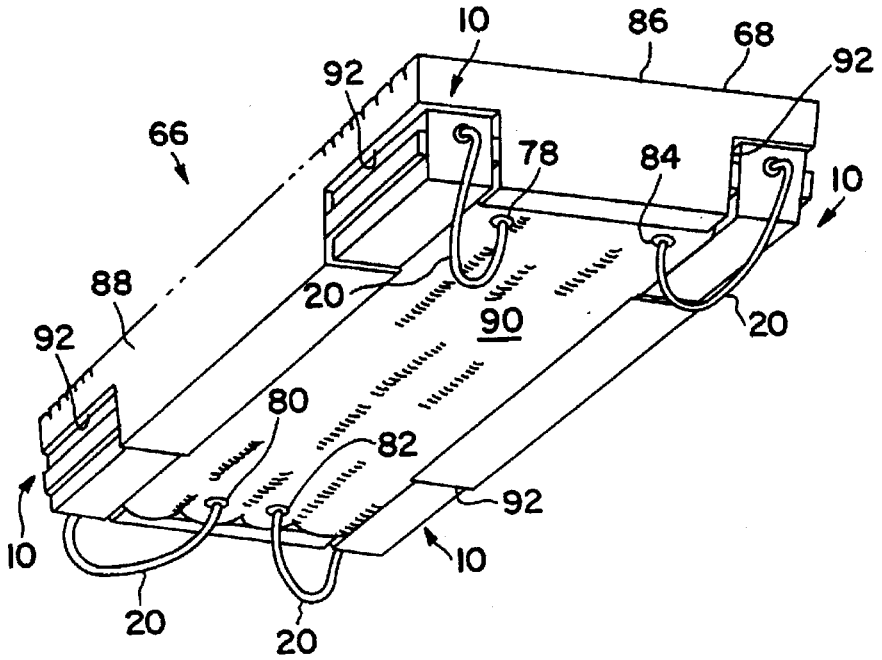
FIG. 2A is a generally bottom and side perspective view of an exemplary first support arrangement in accordance with the subject invention.
Figure 2B:
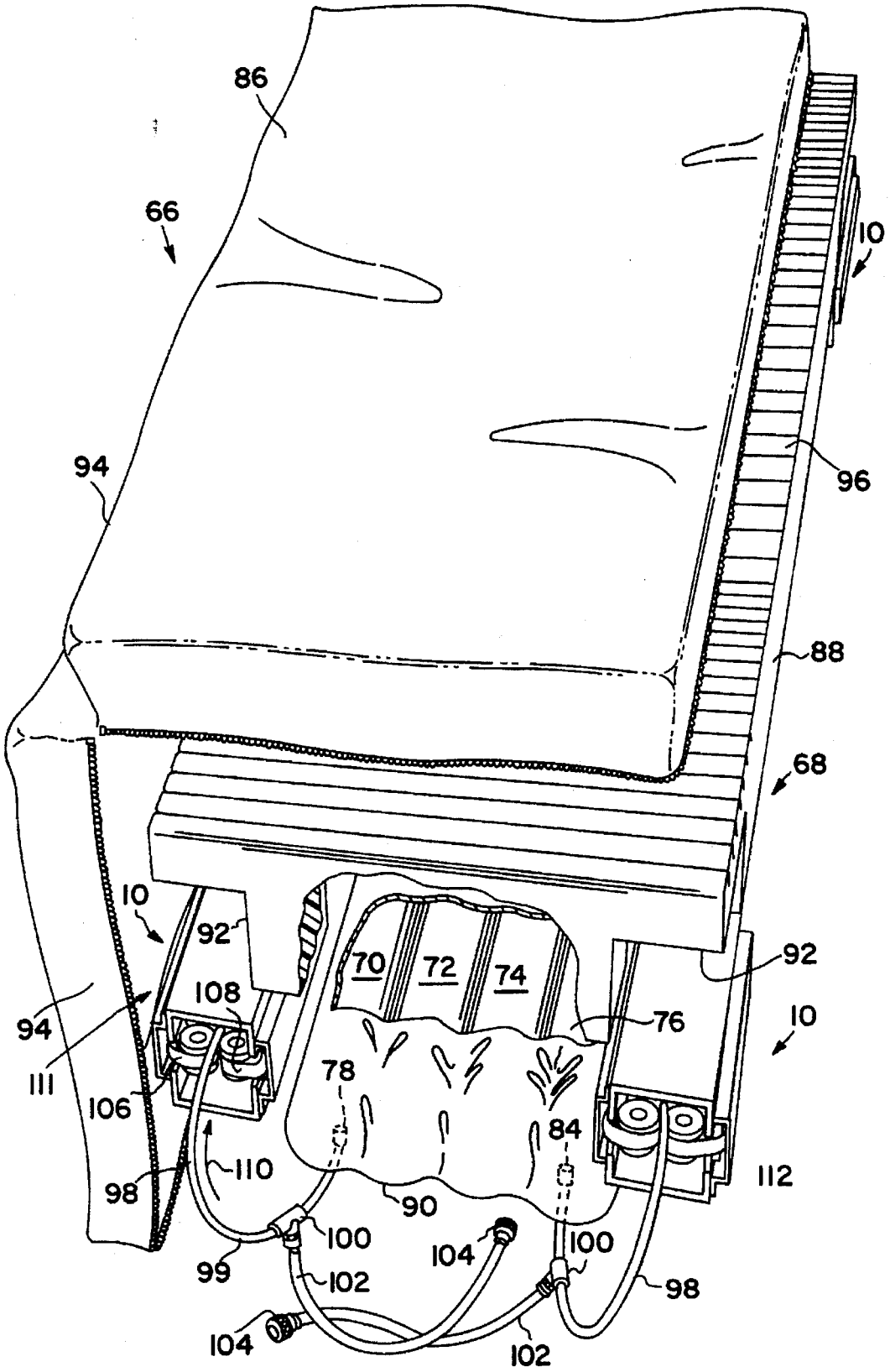
FIG. 2B is a generally enlarged and exploded (with partial cutaway) perspective view of the present exemplary embodiment of FIG. 2A.

FIGS. 2A and 2B represent a first embodiment of an exemplary support arrangement in accordance with the present invention. In particular, a self-adjusting pressure relief patient support apparatus generally 66 is shown in a generally bottom and end perspective view in present FIG. 2A, and shown in an enlarged, generally exploded (and partially cutaway) view in present FIG. 2B. Such apparatus 66 may assume a variety of configurations, with one preferred arrangement thereof generally being represented and discussed in U.S. Pat. No. 5,070,560, the disclosure of which is fully incorporated herein by reference.

In particular, a main support body generally 68 is provided for receiving a patient thereon, and has at least one adjustable fluid support bladder for receiving fluid therein. As represented in present FIGS. 2A and 2B, four respective longitudinal support bladders or fluid chambers 70, 72, 74, and 76 are provided. Such fluid cylinders, 70, 72, 74 and 76 may correspond generally with the plurality of air cylinders 1 of U.S. Pat. No. 5,070,560 or may assume other configurations and embodiments. However, as otherwise represented in present FIGS. 2A and 2B, each of such fluid support bladders are preferably associated with one of the self-adjusting components 10, as discussed above in present FIGS. 1A through 1D.

In accordance with present methodology, if desired, components 10 with different operating characteristics may be used so as to provide corresponding different support characteristics in the respective support sections of main support body 68. Such practices may be readily obtained such as by the use of different strength springs among the components 10, or by other practices as discussed herein.

More particularly, respective fluid passageway means 20 may be provided for connecting each constant force reservoir means 10 in fluid communication via bladder ports 78, 80, 82, and 84, with respective bladders, 70, 72, 74 and 76. In such fashion, a plurality of fluid reservoirs are provided each in respective fluid communication with a respective one of the fluid chambers, 70, 72, 74, and 76. With the other constant force features described in conjunction with components 10 (for example, using the exemplary potential energy of the constant force linear spring(s) associated therewith), each chamber is independently automatically adjusted so as to independently maintain a generally constant predetermined internal pressure in the respective chamber responsive to changing patient loading on main support body 86.

Other arrangements may be practiced, including pairing of support bladders with a given self-adjusting component 10, or the pairing of components 10 with a given fluid support bladder.

Still further, the construction of present FIGS. 2A and 2B illustrates one example of an arrangement for sectionalized support, wherein multiple independently acting support sections are provided in a mattress overlay or mattress replacement, generally 66, without requiring any external control features. More particularly, and with further reference to incorporated subject matter of U.S. Pat. No. 5,070,560, a resilient foam layer generally 88 may be provided over and/or around the support bladders, 70, 72, 74, and 76, which may otherwise be received in a protective envelope generally 90. As illustrated, cut out sections 92 of foam body 88 may form notched areas or similar for receiving components 10. As will be understood by those of ordinary skill in the art, appropriate fluid passageway means 20 may be utilized for relocating components 10 (or other equivalent components in accordance with the subject invention) relatively outside the apparatus 66. However, with the arrangement illustrated in present FIGS. 2A and 2B, components 10 are advantageously receivable inside of an enclosable or zippered covering 94.

It will be understood by those of ordinary skill in the art that additional features may be practiced. For example, foam member 88 may be provided with a sectionalized upper surface 96, such as one of the particular surfaces discussed above with other patents, the disclosures of which were incorporated herein by reference. For example, see the disclosure of U.S. Pat. No. 4,862,538, incorporated herein by reference. All such variations and uses are intended to come within the spirit and scope of the present invention.

Likewise, variations in the location and/or number of fluid support bladders may be practiced. Similarly, the type of fluid utilized (whether gaseous or liquid or the like) may be varied in particular embodiments without departing from the spirit and scope of this invention.

Further, additional aspects may be practiced. For example, as represented in present FIG. 2B, fluid passageway means provided by tubing 98 may incorporate T-connectors 100 for providing further hoses 102 and corresponding quick release nipples or connectors or the like 104. Although not required for operation of the apparatus 66, nor for practice of the present invention, such coupling connectors 104 could provide a convenient point for taking pressure gage readings, which would reflect the pressure within the corresponding bladders 70 and 76. Similar connectors may be provided in conjunction with bladders 72 and 74, or whatever other number and location of bladders are practiced.

Also, such connectors 104 may provide access to an otherwise sealed fluid arrangement between the respectively corresponding bladders and reservoirs, so that the initial amount of fluid in each such grouping may be predetermined and/or otherwise selected. Also, later adjustments may be conveniently made with such an arrangement.

The importance of such feature may be most significant in conjunction with uses of different embodiments at different altitudes, since the local atmospheric pressure would vary. By opening to local atmosphere a valve added to connector 104 (while there was no loading on the corresponding main support body), the initial pressure in a tube could be appropriately established for a given altitude. Those of ordinary skill in the art will appreciate various atmospheric biasing and correction aspects which may be practiced such as through use of connectors 104, without additional discussion thereof, and the inherent adjustment advantages for altitude variations presently obtained. Likewise, it will be understood that pressure data obtainable through connector 104 may be tracked, if desired, either locally or remotely, or in real time or on stored medium for later consideration. With properly handled data, patient weight information may be obtained.

Considering the interaction of the self-adjusting components 10 with the illustrated support arrangement 66 of present FIGS. 2A and 2B, the following is a brief description of the automatic adjustment operations thereof. First, it will be understood by those of ordinary skill in the art that the various fluid support bladders 70, 72, 74 and 76, will receive differential loading depending on the exact placement and physical characteristics of a patient (medical market) or user (consumer market) situated thereon. In any event, the corresponding fluid reservoir, and constant force devices associated therewith via the fluid communication of conduits 20, will provide respective and independent reaction to the loading changes on each respective bladder.

Taking bladder 70 as an example, when in a no load condition, the constant force springs 106 and 108 should compress the respective reservoir (bellows) therein, similar to FIG. 1C as discussed in conjunction with self-adjusting component 10. Of course, the residual amount of fluid in the grouping may oppose the complete axial compression of the bellows, such that an equilibrium pressure point is reached without full bellows compression. While such may occur during permitted operations, it also provides an opportunity to make use of a coupling connector 104 for bleeding off "excess" amounts of fluid. By doing so, the effective expansion range of the bellows is increased, which correspondingly increases the amount of weight change which may be compensated with bladder 70.

Whenever no load is received on bladder 70, upon initial receipt of such load (for example, a patient being placed on apparatus 66), the internal pressure of bladder 70 would tend to increase if there were no outlet for a portion of the fluid received therein. However, in accordance with the subject invention, a portion of such fluid is communicated in the direction of arrow 110 along conduit 99 towards the associated self-adjusting component 111. As such occurs, the reservoir (bellows) within such component 111 tends to be expanded, which in turn is opposed by the generally constant forces applied with constant force springs 106 and 108. Movement in an expanding direction continues until an equilibrium point is established, at which a generally constant predetermined internal pressure will have been maintained automatically within the grouping of such self-adjusting component 111 and bladder 70. It is to be understood that the reserve fluid flow and spring operation occurs if loading on bladder 70 relatively decreases. Such automatic adjustments are achieved, although no pressure sensory feedback is made, nor any control system utilized for actively pumping fluid into or out from bladder 70.

With the arrangement of present FIGS. 2A and 2B, it will be understood by those of ordinary skill in the art that remaining illustrated bladders 72, 74, and 76 are intended to behave in similar fashion with their respective self-adjusting components 10, in accordance with this invention.

Preferably, the constant force springs 106 and 108 are linear. However, in certain embodiments of the present invention in which other components of the system may not have a linear response, the response of such self-adjusting component 10 or specific features thereof may be likewise made non-linear, so that an overall linear system (if desired) results. For example, if the volume change response of a given reservoir is known to be non-linear (for example, such as due to the shape thereof or interaction of the actuation elements therewith), then the actuation force applied may be non-linear in a corrective or complementary fashion. Likewise, if an associated bladder has a non-linear response, the response of device 10 may be rendered complementary thereto so that a net linear support system (if desired) results. All such design variations are intended to come within the spirit and scope of the present invention.

In the case of a constant force linear spring, variations in linearity at given points of travel may be variously obtained. For example, notched out sections 112, such as represented in dotted line in FIGS. 1A and 2B, may be provided for varying the otherwise linear response of a spring. In general, the strength of a constant force linear spring is determined by its thickness, width, and coil size. Therefore, proportional strength changes may be introduced by removing sized portions of the spring. All such variations are intended to come within the spirit and scope of the present invention, by virtue of present reference thereto.

Similarly, use of reference to constant force, within the context of the subject invention, is intended as meaning at least a generally constant force, or some specific predetermined response, which in fact might be deliberately non-constant at a force level, but which force, in conjunction with operation of the remaining components, results in a net generally constant pressure (if desired) within a fluid system with which the apparatus is operative. As referenced above, certain systems may be specifically designed for a deliberate non-linear response, or otherwise customized in accordance with this invention. For example, a particular support system arrangement may be provided based on patient parameters obtained at the time of hospital admission, with the customized support system prepared by the time the patient reaches his or her room. Such an approach could be a basis for lowered liability insurance for the hospital, since the occurrence, for example, of bed sores can otherwise prompt claims.

In addition to the numerous support arrangement variations which may be practiced, including longitudinal, lateral, angular, and mixed arrangements of single or multiple fluid support bladders or fluid chambers, in accordance with this invention, it is also to be understood that numerous self-adjusting components may be provided in accordance with this invention for use with various such support arrangements. The following disclosure provides additional specific examples of such alternative self-adjusting components in accordance with this invention.

Generally speaking, any self-adjusting component in accordance with the subject invention may be substituted in place of components 10 shown by exemplary representation in the combination support arrangement of present FIGS. 2A and 2B. Also, different components and/or a different operatively rated (i.e., responsive) components may be variously mixed in a given support system arrangement and methodology. However, it will be apparent to those of ordinary skill in the art that the combination represented in present FIGS. 2A and 2B particularly makes use of fluid passageway means for interconnecting respective fluid support bladder and reservoir features, while in certain of the further embodiments hereinafter discussed, a self-adjusting component in accordance with this invention may be disposed for acting more directly on a fluid support bladder.

In general, the self-adjusting components represented in present FIGS. 1 through 9B, inclusive, provide various examples of constant force fluid reservoir means for automatically adjusting a fluid support bladder using potential energy. In such embodiments, the fluid reservoir means are provided in fluid communication with the fluid support bladder via the fluid passageway means. It will be understood that one or more of such arrangements may be utilized in a given support arrangement in accordance with the subject invention.

The exemplary embodiments represented by present FIGS. 10 through 17C more specifically illustrate bladder operative devices of self-adjusting components in accordance with the subject invention. In such regard, such various embodiments represent constant force response means in accordance with the subject invention, which may be described as being physically operative with the fluid support bladder for automatically adjusting such bladder(s) using potential energy.

In the case of both the constant force fluid reservoir means and the constant force response means, a generally constant predetermined internal pressure is maintained within a bladder responsive to changing patient loading on the main support body. One or more of all the various self-adjusting component embodiments may be utilized in a given support arrangement, and choice of the components utilized may be made by one practicing the subject invention, particularly whenever addressing specifically presented or encountered design criteria (various of which may not be predictable at this time).

Many of the variations and modifications hereinafter described relate to alternative features for transmitting an actuation force to either a fluid support bladder (fluid chamber) or to a reservoir. Other feature variations relate to arrangements for effecting such actuation force, which as a net effect is desired to be a constant force so as to maintain a constant pressure (whenever such is desired) within one or more fluid support bladders. As alluded to above, certain specialized situations may call for a predetermined response profile which does not result in a maintained constant pressure within one or more fluid support bladders. Those of ordinary skill in the art will appreciate from the present disclosure those modifications and variations which may be made to accommodate such circumstances, within the spirit and scope of the present invention.

Each of the self-adjusting components illustrated or otherwise represented in every figure herewith (or as otherwise suggested or encompassed herein), advantageously incorporates use of potential energy, though provided in various forms. In the context of the present invention, potential energy is as ordinarily defined, i.e., the capacity to do work that a body or system has by virtue of its position or configuration. Primary examples shown herewith relate to potential energy of various illustrated spring arrangements and potential energy of various counterweight arrangements.

Those of ordinary skill in the art will be aware that gravitational force, in general, is everywhere constant. Thus, counterweight arrangements provide a ready source for potential energy capable of rendering a constant force. However, space considerations may limit the desirability of certain of such arrangements since a vertical travel path must exist, which may include travel outside the bounds of a generally horizontal support arrangement (assuming such configuration for certain embodiments). It is to be understood that other embodiments illustrated herewith, particularly those making use of various constant force spring arrangements, are capable of successful operation of the subject invention, in virtually any position or orientation.

Also, any of the present self-adjusting components may be (generally speaking) utilized relatively close to a particular fluid support bladder, or more remotely located therefrom and interconnected thereto via appropriate conduits, as represented, for example, over only a relatively short distance in the embodiments for present FIGS. 2A and 2B.

Figure 3A:
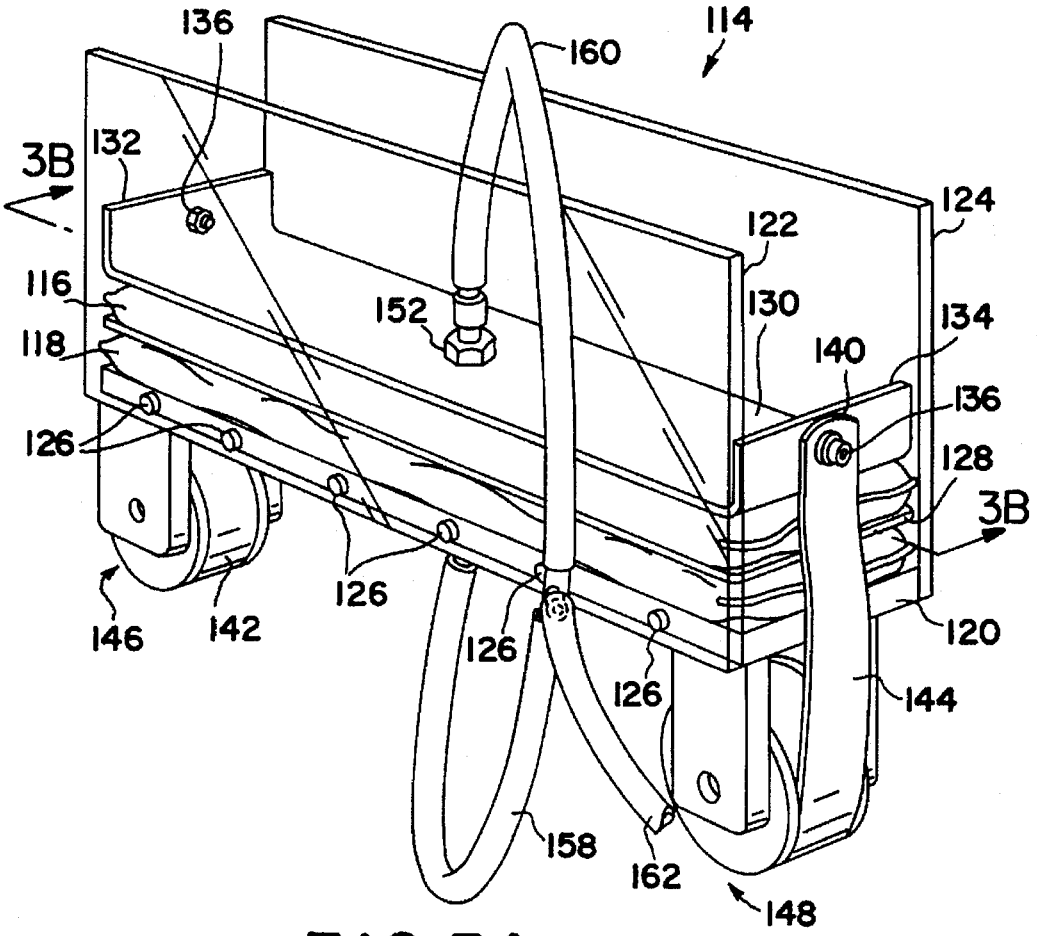
FIG. 3A is a generally perspective view of another exemplary embodiment of a reservoir operative device in accordance with the subject invention, incorporating two separate fluid reservoirs.
Figure 3B:
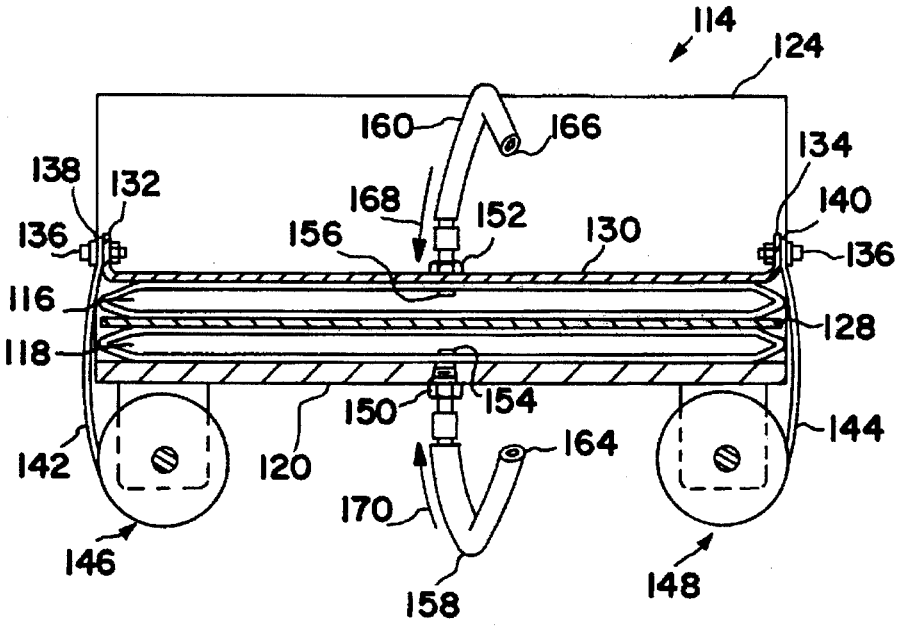
FIG. 3B is a generally side cross-sectional view of the embodiment as in present FIG. 3A, as indicated by section line 3B—3B indicated therein, with the respective fluid reservoirs generally compressed.
Figure 3C:
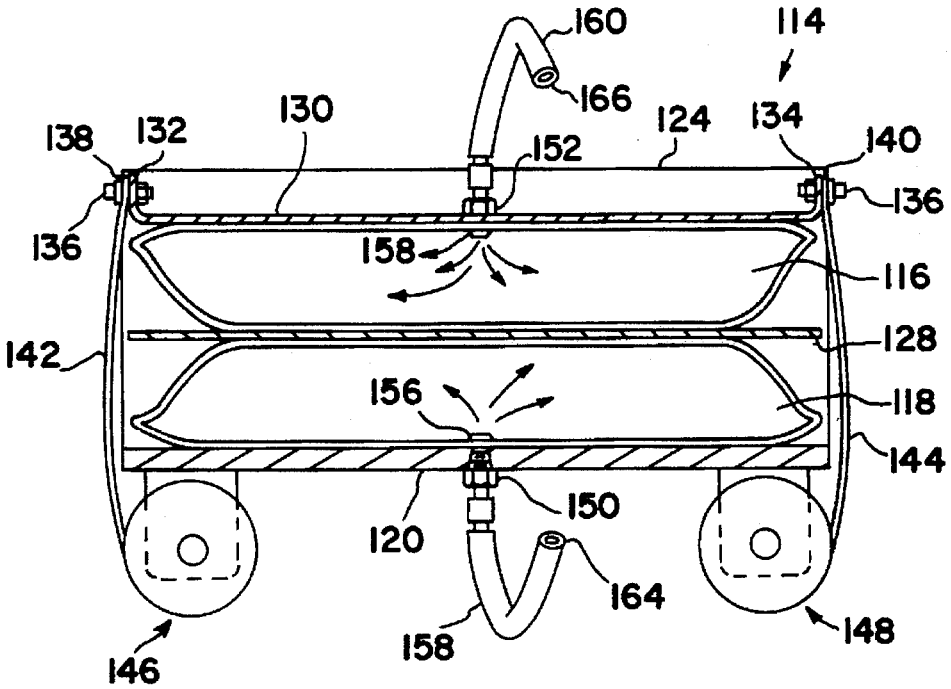
FIG. 3C is a generally side cross-sectional view of the embodiment as in present FIG. 3A, similar to that as indicated by section line 3B—3B indicated therein, but with the respective fluid reservoirs generally expanded.

FIG. 3A represents a generally perspective view of another exemplary embodiment 114 of a self-adjusting component particularly functioning as a reservoir operative device in accordance with the subject invention. FIG. 3B is a generally side cross-sectional view of the embodiment of self-adjusting component 114, as in present FIG. 3A, and as indicated by the sectional line 3B—3B shown therein. A pair of respective fluid reservoirs 116 and 118 are shown generally as compressed in FIG. 3B. FIG. 3C shows, in essence, the same representation as that of FIG. 3B, but with such pair of reservoirs 116 and 118 generally expanded.

Device 114 of FIGS. 3A through 3C generally includes a base plate 120 to which opposing side walls 122 and 124 are attached with the use of bolts, rivets or the like 126. Reservoirs 116 and 118 may be formed as elongated generally fluid sealed tubes or chambers, each having a respective variable volume, and each being received generally between the opposing faces of side walls 122 and 124. At least side wall 122 is illustrated as comprising a Lexan or similar transparent material. Other transparent or opaque materials may be used. It is to be understood that operation of a self-adjusting component in accordance with the subject invention would generally occur out of the user's sight.

Reservoirs 116 and 118 may be separated by a generally planar element 128, which also is received between opposing side walls 122 and 124, and which is preferably rectangular so as to be better guided thereby. Lastly, the reservoirs 116 and 118 are bounded by a movable upper plate 130, which is also guided within the opposing side wall faces. Upward end flanges 132 and 134 of top plate 130 also serve to help guide the movement of various elements, as described hereinafter. Such flanges 132 and 134 also provide attachment areas for connectors 136 (such as nut and bolt arrangements or the like) to secure the respective ends 138 and 140 of constant force springs 142 and 144. Such constant force springs may be received on mounted spool arrangements 146 and 148, such as already described in conjunction with the embodiment of present FIGS. 1A through 1D.

Bottom plate 120 and top plate 130 are provided with respective ports or openings 150 and 152, which align and cooperate with respective ports 154 and 156 of reservoirs 118 and 116. Such arrangement permits fluid communication between the interior and exterior of each respective reservoir.

Ports 150 and 152 also respectively interconnect in fluid communication with flexible fluid tubing 158 and 160. As represented in present FIG. 3A, such respective conduits may converge into a single tube 162, to be interconnected with a fluid support bladder, as described above with reference to present FIGS. 2A and 2B. Accordingly, present FIG. 3A represents use of a plurality of constant force fluid reservoir means in combination with a single support bladder. With such arrangements, a plurality of components 114 could be utilized with a corresponding number of fluid support bladders.

On the other hand, present FIGS. 3B and 3C represent use of the self-adjusting component 114 as two independently operative constant force fluid reservoir means, as follows. As represented in FIGS. 3B and 3C, respective tubes 158 and 160 may have respective connectable ends 164 and 166, which may be associated with separate fluid support bladders. In other words, reservoirs 116 and 118 may be interconnected so as to correspond with different respective independently operative groups of a reservoir/tubing/bladder arrangement.

In present FIG. 3B, constant force springs 142 and 144 are essentially fully retracted about their respective spool arrangements 146 and 148, so that bladders 116 and 118 are correspondingly compressed. In particular, reservoir 118 is compressed between bottom plate 120 and intermediate plate 128, while reservoir 116 is responsive to compressive forces received from such intermediate plate 128 and the top plate 130. As increased weight is received on a fluid support bladder associated with reservoir 116, fluid will tend to flow in tubing 160 in the direction of arrow 168 via ports 152 and 156. Likewise, increasing weight on a fluid support bladder associated with reservoir 118 will tend to cause fluid flow in the direction of arrow 170 into reservoir 118 via tubing 158 and ports 150 and 154.

If fluid tends to flow into either reservoir 116 or 118, expansion of such reservoirs will tend to force top plate 130 and/or intermediate plate 128 away from bottom plate 120, which will cause a corresponding draw off of springs 142 and 144 from their respective spools 146 and 148. FIG. 3C illustrates a condition in which additional fluid has been forced into both reservoirs 116 and 118, with a resulting expansion of both such reservoirs and draw off of springs 142 and 144 until a condition of equilibrium has been reached.

From the discussion above, it will be understood by those of ordinary skill in the art that achievement of such equilibrium position (responsive to a constant actuation force) acts to maintain a generally constant predetermined pressure in the respective bladders, responsive to changing patient loading thereon.

It will be further understood that the weight compensating range of the subject invention is limited in each given embodiment, generally speaking, by the adjustable reservoir capacity. FIG. 3C illustrates a nearly full expansion of the respective reservoirs 116 and 118. It should be apparent that the overall component 114 may be relatively larger or smaller in size, as needed, to accommodate incorporation into various support arrangements which may be selected by those practicing the subject invention.

Similarly, adjustments to performance may be made by changing the spring force constant of springs 142 and 144, or otherwise introducing appropriate dampening or resiliency effects. For example, the reservoirs 116 and 118, and for example, the bellows 18 of the first embodiment, may be formed of materials such as to themselves effect part or all of the actuation forces discussed herein. However, in the embodiments thus far discussed, the reservoirs themselves are intended as providing little or no friction or other interactive forces, but instead are intended to be controlled and acted on by the components otherwise illustrated and discussed.

Figure 4:
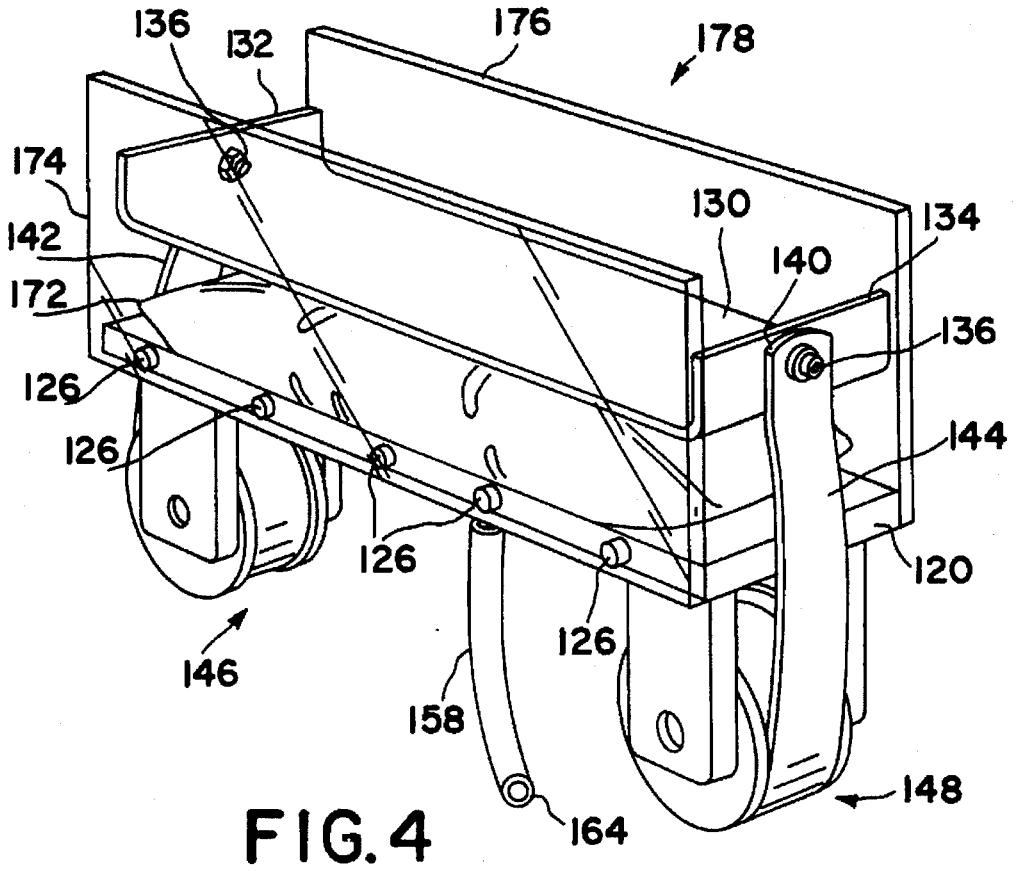
FIG. 4 is a generally perspective view of a further exemplary embodiment in accordance with the present invention of a reservoir operative device, similar in various respects to that shown in present FIG. 3A, but involving only a single fluid reservoir.

FIG. 4 illustrates an alternative of the embodiment of present FIGS. 3A through 3C, wherein only a single reservoir 172 is provided. In such instance, opposing side walls 174 and 176 may be the same size as opposing side walls 122 and 124, so that a generally larger reservoir 172 is provided, or such side walls may be one-half the height or other relatively smaller dimension in relation to side walls 122 and 124. In such latter case, self-adjusting component 178 would be relatively smaller than the dual reservoir self-adjusting component 114, which could be advantageous in certain embodiments where component size was of particular concern. Otherwise, for the sake of brevity and simplicity, like features of FIG. 4 are labeled with the same reference characters as used in FIGS. 3A through 3C, wherefore additional specific discussion is not required. It will be appreciated by those of ordinary skill in the art that other embodiments of this invention may include the use of three reservoirs or more stacked and separated between opposing side wall faces, with suitable modifications as will be readily understood.

It will likewise be understood by those of ordinary skill in the art that certain support arrangements will require relatively small reservoir capacities than those of certain other embodiments. For example, a longitudinal fluid support bladder received along the entire length of a mattress would preferably make use of a reservoir having a relatively larger capacity, such as coming within a range of about 100 to 200 cubic inches (or some other size), while a relatively smaller support section defined by a bladder such as in a small segment of a wheelchair support arrangement, would make use of a relatively smaller reservoir capacity. Accordingly, those of ordinary skill in the art will understand that embodiments such as those of present FIGS. 1A, 3A, and 4 may be physically scaled in accordance with this invention so as to provide and make use of desired reservoir sizes and suitable spring force ratings or other appropriate actuation means or ratings for operating same, as needed.

Figure 5:
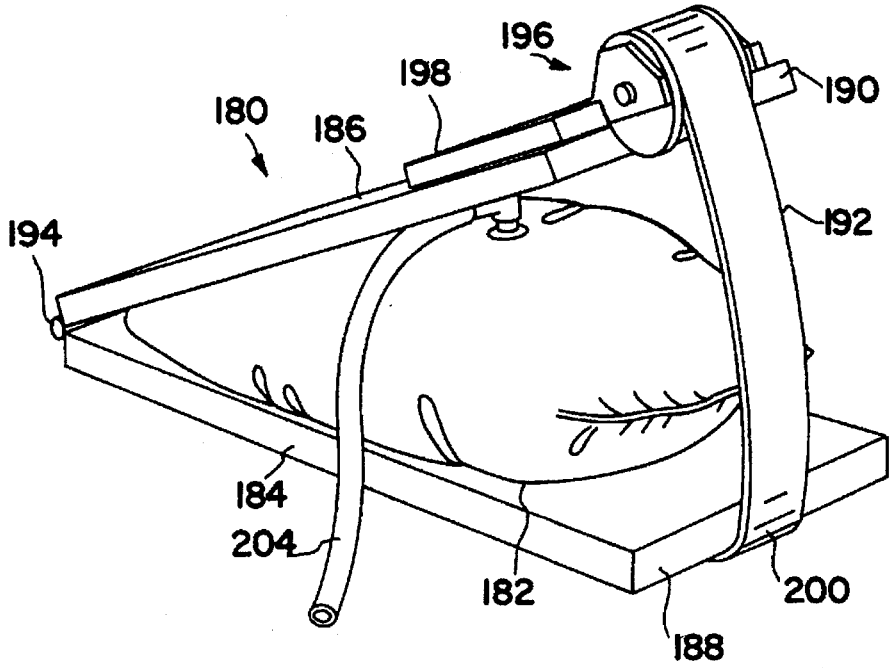
FIG. 5 is a generally side perspective view of a further alternate embodiment of the subject invention concerning a reservoir operative device incorporating a single fluid reservoir.

In contrast with prior discussed embodiments, the self-adjusting component generally 180 of present FIG. 5 makes use of pivoting members for applying force to a reservoir 182, instead of parallel planar movement of members. As shown, reservoir 182 is generally trapped between opposing sides of two pivoting members 184 and 186. The relatively distal (or moving) ends 188 and 190 of such respective members are drawn in a direction towards one another by a reservoir actuation means arrangement, such as a constant force spring 192. Members 184 and 186 are suitably joined by any form of pivoting element or hinges 194. A spool arrangement 196 may be mounted on one of the pivoting members, such as with a spool support element 198. At the same time, the distal or draw-off end 200-of constant force spring 192 may be otherwise secured to the opposite pivoting member. Suitable connecting elements, such as bolts or the like may be used for such purpose, as described in other embodiments in this disclosure.

Similar to other embodiments herewith, a port or the like 202 may be provided in a desired portion of reservoir 182, to provide fluid communication with fluid passageway means 204. As previously discussed, one or more fluid support bladders or fluid chambers may be operatively interconnected with reservoir 182 via such conduit 204. Depending on design constraints and criteria, the port 202 may be variously located in relation to bladder 182, primarily so as to provide convenient access or functional reliability, as needed.

Figure 6:
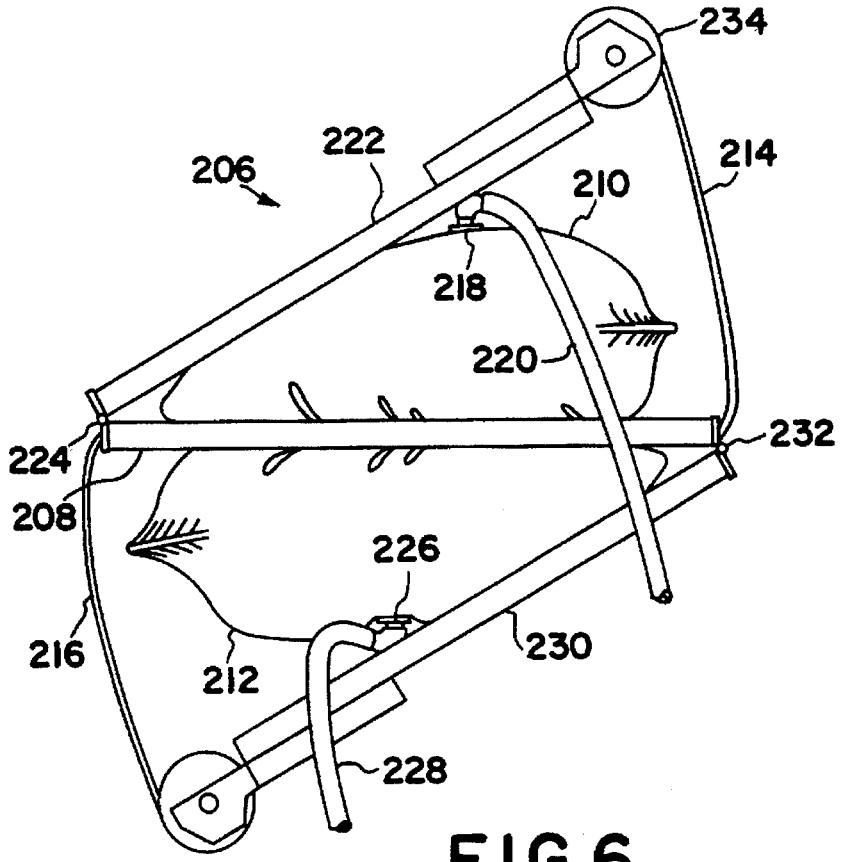
FIG. 6 is a generally side elevational view of a further embodiment of a reservoir operative device similar to that of present FIG. 5, but involving two such devices employed in cooperative tandem with two fluid reservoirs.

Similar to the relationship between the exemplary embodiments of present FIGS. 3A and 4, FIG. 6 illustrates a tandem arrangement generally 206 of the components 180 of present FIG. 5, with a shared or common member 208 therebetween. One difference in the comparison is that each reservoir 210 and 212 in such tandem arrangement has its own respective constant force device (for example, a constant force spring 214 or 216) whereas springs 142 and 144 had shared usage for bladders 116 and 118 in the figures described above.

As shown, subject to mounting constraints, reservoir 210 has its own port 218 and corresponding fluid interconnecting tubing 220 so that fluid movement may be desirably affected by the cooperation of spring 214 and opposing pivoting members 208 and 222 (in conjunction with pivot mount elements 224). Reservoir 212 has a similar (but separate) arrangement, including a port 226 in fluid communication with fluid conduit 228. A further movable member 230 cooperates with base or shared member 208 for applying various compressive forces (under actuation forces from spring 216) acting above pivot mounting elements 232. Respective springs 214 and 216 may again be received on supporting spool arrangements 234, generally as described above.

Those of ordinary skill in the art will appreciate and understand the operational mechanics of such FIGS. 5 and 6 without additional discussion, such FIG. 5 representing a generally side perspective view of the subject alternative embodiment, with FIG. 6 representing a generally side elevational view of such exemplary cooperative tandem arrangement with two fluid reservoirs.

Figure 7:
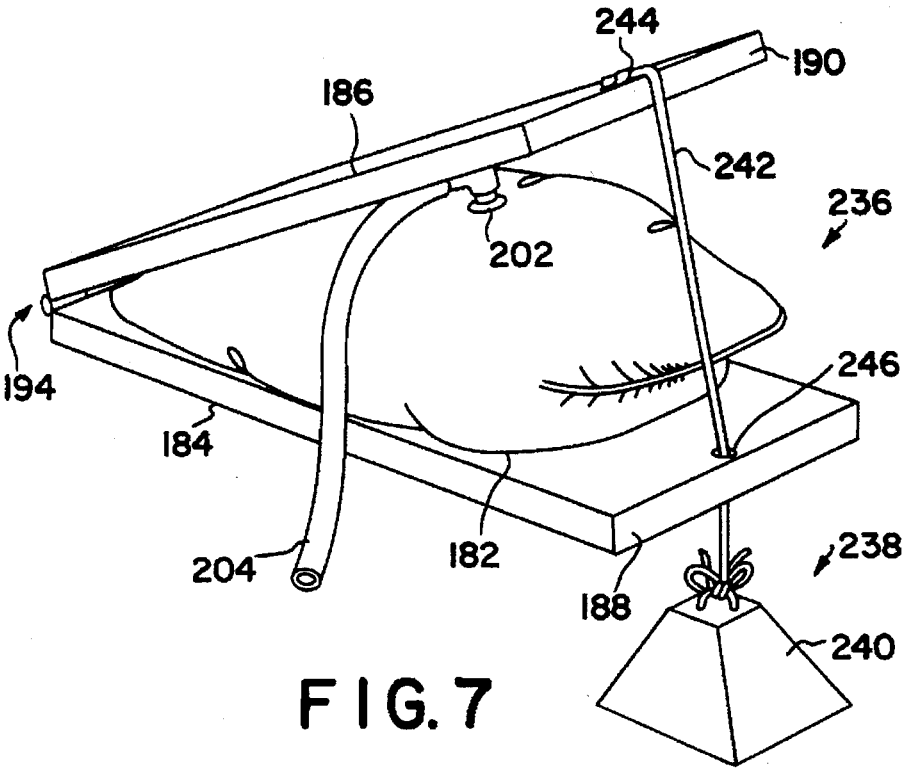
FIG. 7 is a generally side perspective view of a further exemplary embodiment in accordance with the subject invention, concerning a reservoir operative device similar in various respects to the present exemplary embodiment of FIG. 5, but having a counterweight arrangement.

FIG. 7 represents yet a further alternative embodiment in accordance with the subject invention, as shown in a generally side perspective view. The embodiment of present FIG. 7 is most similar to the arrangement of present FIG. 5 and reference characters therefrom for like elements are repeated in FIG. 7, without requiring additional discussion thereof. The primary difference between the embodiments comprising self-adjusting component generally 180 (FIG. 5) and component 236 (FIG. 7) is the manner in which actuation force is applied to the reservoir actuation means including opposing pivoting movable elements 184 and 186. While the constant force actuation means of present FIG. 5 are based on use of a single constant force spring 192, a counterweight arrangement generally 238 is instead used in present FIG. 7.

Counterweight arrangement 238 includes a specific weight 240, which may comprise metal, contained water, or other materials having adequate density and weight suitable for the purpose. Weight 240 is secured through a connecting line (cable, chain, string, etc.) or similar 242. One end of such line 242 is connected at pivot 244 with the distal end 190 of pivoting member 186. Another portion of connecting element 242 is passed through a guide opening or similar arrangement 246 associated with distal end 188 of member 184. By such arrangement, a constant force from the weight of member 240 is applied to the distal end 190 of upper member 186, acting along a direction generally towards the distal end 188 of lower member 184. It will be readily apparent to those of ordinary skill in the art that the remaining features and aspects of the subject invention embodied in self-adjusting component 236 otherwise operate and function as heretofore generally described relative to component 180.

Figure 8:
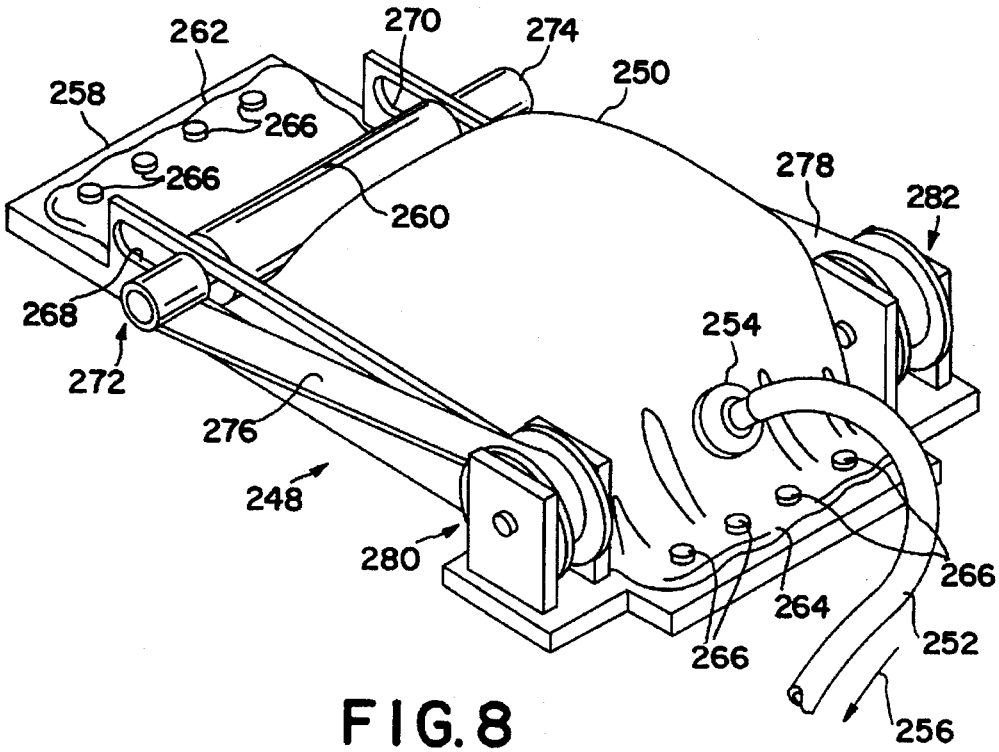
FIG. 8 is a generally side perspective view of yet a further exemplary embodiment of a reservoir operative device in accordance with the subject invention.

FIG. 8 represents a generally side perspective view of yet a further exemplary embodiment of a reservoir operative device generally 248 in accordance with the subject invention. More particularly, such arrangement 248 includes reservoir actuation means, equivalent to those of other embodiments herein discussed, responsive to an actuation force applied thereto for acting on a reservoir 250 with a force tending to push fluid from such fluid reservoir into a fluid passageway means 252 via a port generally 254 in the direction (arrow 256) of a support bladder (not shown). Such reservoir actuation means in the embodiment of present FIG. 8 may comprise at least two members, relatively movable with respect to each other and mutually cooperative for transmitting such actuation force to reservoir 250.

In the exemplary embodiment of present FIG. 8, such two members may include one support member generally 258 with the reservoir 250 supported thereon, and one movable member generally 260 movable relative to the support member 258 for engaging the reservoir 250 between the two members (as illustrated) so as to transmit an actuation force to such reservoir. Preferably, support member 258 comprises a generally planar member with opposing ends generally 262 and 264 of reservoir 250 secured thereon, such as with fluid sealing bolt arrangements 266, or the like. Fluid port 254 is formed relatively adjacent to reservoir end 264 and is in fluid communication with the fluid passageway means 252, as will be readily understood by those of ordinary skill in the art from FIG. 8 itself.

The movable member 260 preferably comprises a generally cylindrical member (as illustrated) mounted intermediate the reservoir opposing ends 262 and 264 for movement therebetween and for engagement with such reservoir 250 such that fluid in the reservoir is forced towards (and through) port 254 by movement of cylindrical member 260 towards end 264. As further shown, guide channels generally 268 and 270 may be formed and supported along respective lateral sides of support member 258, with respective axial ends of cylindrical member 260 extending therethrough. Such arrangement permits guidance of desired travel of member 260. Each respective end 272 and 274 of cylinder 260 may be associated with a respective constant force spring 276 and 278 mounted on respective spool arrangements 280 and 282. With such an arrangement, a generally constant actuation force is applied to the above-described reservoir actuation means. As with other embodiments, the net effect is that incoming fluid flow to reservoir 250 (opposite to the direction of arrow 256) is met by the opposing (generally constant) forces obtained from the potential energy of springs 276 and 278, until an equilibrium point is achieved, at which a generally constant predetermined internal pressure is maintained for the bladders in fluid communication with conduit 252.

Similar to other tandem arrangements discussed above, those of ordinary skill in the art will appreciate that support member 258 may support an additional arrangement as shown in FIG. 8, on the lower or reverse side thereof.

Figure 9A:
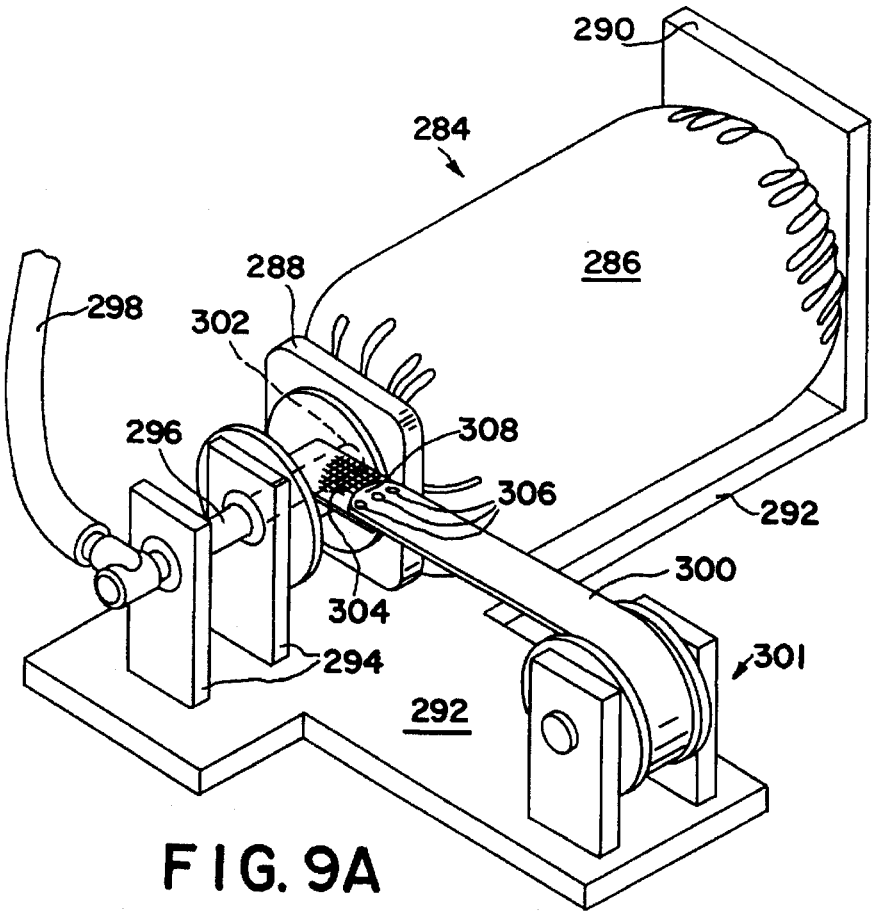
FIG. 9A is a generally side perspective view of a still further exemplary embodiment of the subject invention concerning a reservoir operative device, and in which the illustrated reservoir is represented in a generally expanded condition.
Figure 9B:
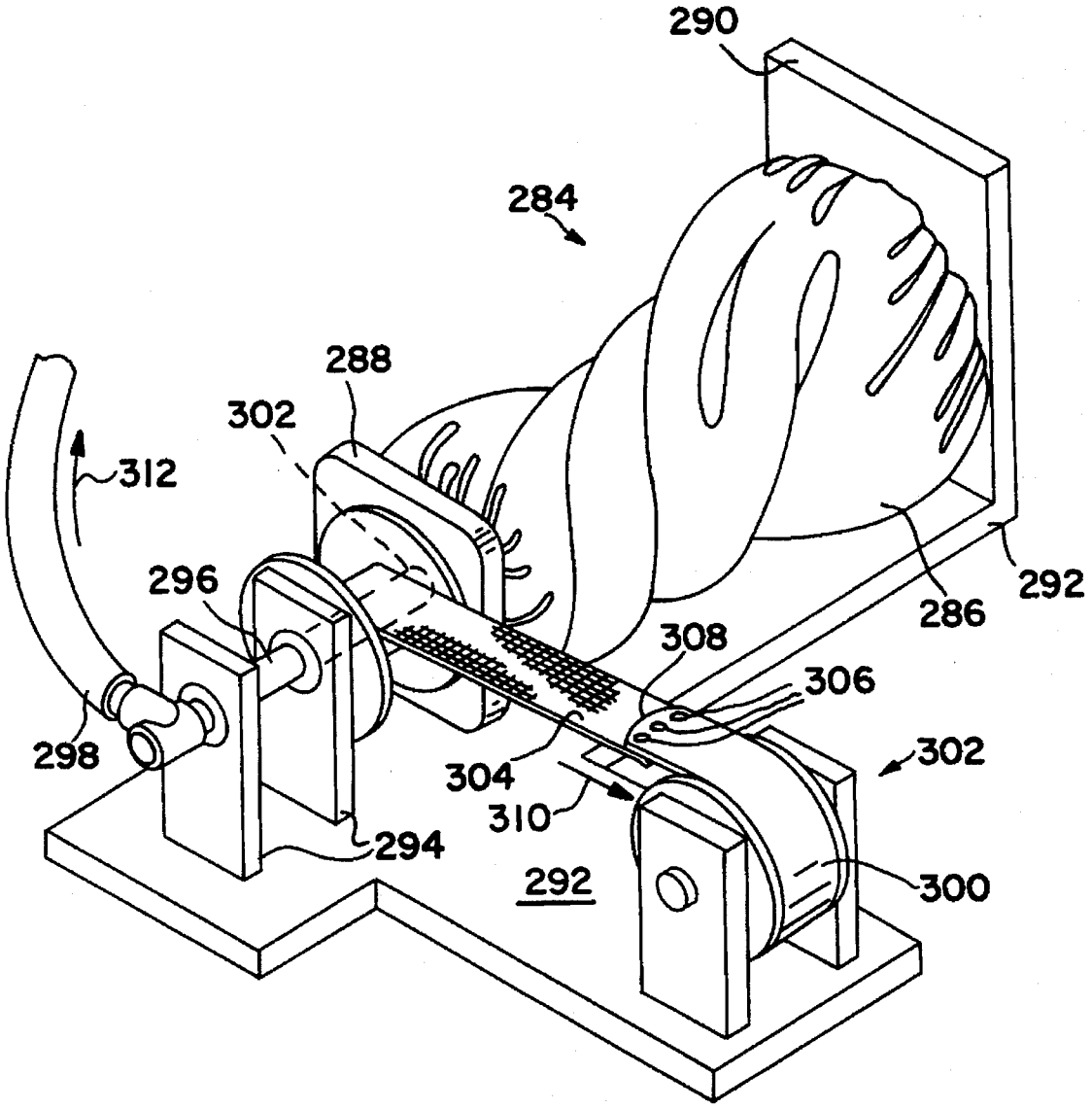
FIG. 9B is a generally side perspective view of a still further exemplary embodiment of a subject invention concerning a reservoir operative device such as in FIG. 9A, and in which the illustrated reservoir is represented in a generally partially compressed condition.

FIG. 9A is a generally side perspective view of a still further exemplary embodiment of the subject invention concerning a reservoir operative device generally 284. In such FIG. 9A, the illustrated reservoir generally 286 is represented in a generally expanded condition. FIG. 9B represents a generally similar viewpoint as that of FIG. 9B, but with the illustrated reservoir 286 represented in a generally partially compressed condition, achieved through relative axial twisting movement, as discussed hereinafter.

In the embodiment 284 of present FIGS. 9A and 9B, the reservoir actuation means thereof preferably comprises a pair of relatively planar elements 288 and 290 received for axial twisting movement relative to each other with reservoir 286 secured therebetween. As a result, reservoir 286 receives a varying torsional force depending on the degree of twisting movement of the two members 288 and 290.

Reservoir 286 may be secured to the respective members 288 and 290 with features similar to those used to secure bellows 18 of the embodiment in present FIGS. 1A through 1D, or suitably otherwise, such as with epoxies or other materials, the details of which form no particular aspect of the subject invention, so long as a fluid sealed arrangement is obtained.

As illustrated, member 290 may be variously supported in a fixed position relative to an exemplary base 292, which also provides a support arrangement 294 for the pivot mounting of member 288 about an axis 296. Such axis 296 also may be provided with a pivoting (i.e., rotatable) fluid sealable coupling, as well known to those of ordinary skill in the art, to permit fluid movement into and out from reservoir 286 via fluid conduit 298. If desired, a fluid coupling may be provided instead on the end of reservoir 286 associated with member 290, so that a rotational coupling is not needed so long as an appropriate port is provided. In other words, fluid conduit 298 could instead emerge from the end of reservoir 286 adjacent member 290, without requiring a rotatable coupling.

A constant force spring 300 may be received on an appropriate supporting spool arrangement generally 301, also mounted on support base 292. It will be understood that the various elements 290, 294, and 301 may be supported on separate members, if desired, instead of on common base 292.

As shown, constant force spring 300 is operatively associated with region 302 of the rotation axis 296 associated with axial twisting member 288. Given the relatively smaller diameter in such region 302 in relation to the diameter of the support spool arrangement 301, a relatively flexible webbing 304 may be appropriately coupled with elements 306 to the distal end 308 of constant force spring 300. Typically, such springs are formed of various metals, such as stainless steel, and use of flexible webbing 304 can prevent any potential problem as to proper wrap around rotational axis region 302. It will be understood that the end of flexible webbing 304 opposite that secured to end 308 of spring 300 should be suitably secured to the rotational axis region 302.

Similar to FIGS. 3C and 5 through 7, FIG. 9A represents reservoir 286 in a generally fully expanded condition thereof, generally as would occur as a result of substantial weight being applied to a fluid support bladder associated with fluid conduit 298. In relation to FIG. 9A, it will be understood by those of ordinary skill in the art that present FIG. 9B illustrates a substantially relatively unloaded condition of such fluid support bladder, such that constant force spring 300 has retracted flexible webbing 304 in the direction generally of arrow 310 for corresponding rotation of relatively movable member 288, with a corresponding degree of axial twisting applied to reservoir 286. As a result of compressive twisting, fluid flow towards a fluid support bladder occurs generally in the direction of arrow 312 via conduit 298, so that the corresponding fluid support bladder tends to become more fully inflated as loading thereon is decreased. However, it will be understood by those of ordinary skill in the art that it may be generally desired for some user-specified purpose to arrange the initial amount of fluid within a bladder/fluid conduit/reservoir grouping so that the bladder is never entirely full of fluid, particularly such as in the case of a fluid support bladder comprising a longitudinal membrane, as represented in present FIGS. 2A and 2B. Such a partially filled arrangement advantageously permits the fluid support bladder to conform to a degree to the shape of the patient received thereon, separate and apart from the self-adjusting features of the subject invention.

As referenced above, the exemplary embodiment of present FIGS. 10 through 17C relate more specifically to exemplary constant force response means in accordance with the subject invention, being physically operative with a fluid support bladder such as in a main support body for receiving a patient thereon. Such constant force response means, generally, functions for automatically adjusting an associated bladder using potential energy so as to maintain a generally constant predetermined internal pressure in such bladder responsive to changing patient loading on the main support body. Such embodiments provide a similar function in relation to single or multiple fluid support bladders, even in non-patient support arrangements, such as in consumer market products or in packaging arrangements such as for the shipment of fragile goods. It will also be understood by those of ordinary skill in the art that the self-adjusting component embodiments hereinafter discussed or suggested may be used in various combinations with different support arrangements, with single or multiple fluid support bladders (as in earlier described embodiments) or in still other variations as referenced or suggested above.

Generally speaking, the embodiments of present FIGS. 10 through 17C are intended as being operative with a bladder or chamber of the type comprising a fluid sealable membrane adapted to be variably compressed by the action of elements pressing (i.e., engaging) the bladder.

Figure 10:
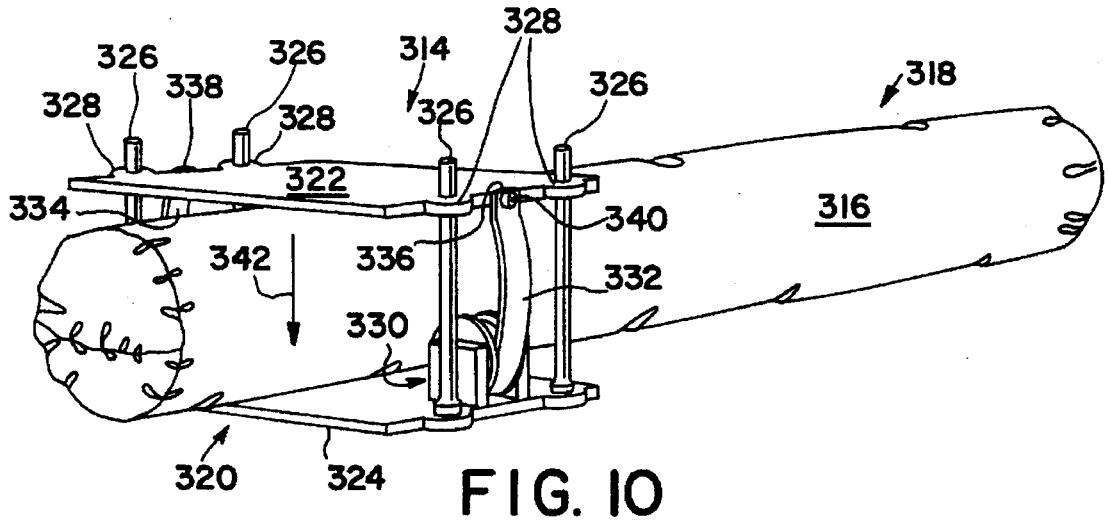
FIG. 10 is a generally side perspective view of a first exemplary embodiment of the subject invention concerning a bladder operative device.

With reference to exemplary FIG. 10, a self-adjusting component generally 314 is shown in generally side perspective view, and concerns a bladder operative device functional with an exemplary such bladder generally 316. Though such bladder 316 is shown as a single or integral sealable membrane, the interaction therewith of self-adjusting component 314 tends to cause fluid within bladder 316 to be segregated between a defined principal region generally 318 thereof versus a defined secondary region generally 320 thereof.

As represented, defined principal region 318 is relatively larger than defined secondary region 320. Principal region 318 is also primarily intended for providing patient support (or support for fragile materials being shipped or the like), while secondary region 320 is not primarily intended for such direct support. In essence, secondary region 320 performs the function of a reservoir, generally as referenced above with the reservoir operative devices of FIGS. 1 through 9B. In such capacity, self-adjusting component 314 tends to regulate the flow of fluid between regions 318 and 320, so that a generally constant predetermined internal pressure is maintained within bladder 316, regardless of changing loading thereon.

As represented by such FIG. 10, bladder actuation means are provided responsive to an actuation force applied thereto for in turn acting on the bladder 316 with a force tending to push fluid from the secondary region 320 thereof into the principal region 318 thereof for patient (or fragile material) support. Such bladder actuation means preferably comprises at least two members, relatively movable with respect to each other and mutually cooperative for transmitting such actuation force to the bladder 316.

As more specifically illustrated, such two members preferably comprise a pair of relatively planar elements 322 and 324, received for relative planar movement parallel to each other with bladder 316 received therebetween. With such an arrangement, bladder 316 receives a varying compressive force depending on the degree of parallel movement of such planar members 322 and 324.

A plurality of upright members 326 may be provided and cooperative with openings generally 328 formed in planar member 322, to serve as guide members for movement of such planar element 322 therealong. While members 326 are described as upright, it is to be understood that, generally speaking, embodiment 314 may be used in various orientations relative to gravity (subject to the placement constraints of associated bladder 316).

As shown, such upright members 326 may be preferably secured to base planar member 324, on which is also received a pair of spool support arrangements 330 associated as before with a constant force spring cooperatively attached with opposing member 322. In this instance, preferably a pair of such springs 332 and 334 are secured at their respective distal ends 336 and 338 to the plate 322 by elements 340. Those of ordinary skill in the art will readily understand that springs 332 and 334 will cooperate to exert an actuation force tending to draw planar member 322 in the direction of arrow 342 towards planar member 324, thereby transmitting the desired engagement to bladder 316 for adjusting (i.e., maintaining) the internal pressure of same responsive to changing loading conditions thereof.

Figure 11:
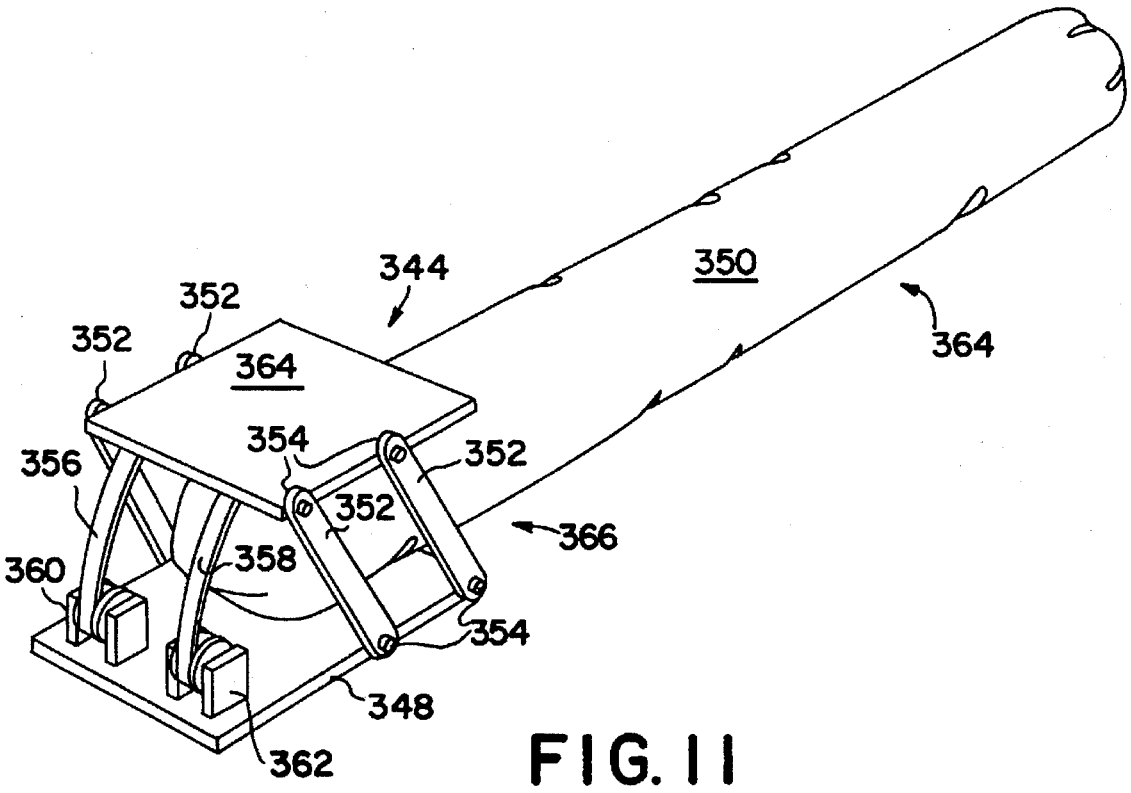
FIG. 11 is a generally side perspective view of a present alternative embodiment of a bladder operative device in accordance with the subject invention.

FIG. 11 is a generally side perspective view of another alternative embodiment of a bladder operative device generally 344 in accordance with the subject invention. In particular, in such embodiment, planar elements 346 and 348 are received for pivoting movement relative to each other with at least a portion of a bladder 350 received therebetween. Hence, such bladder receives a varying compressive force depending on the degree of pivoting movement of the planar elements.

While a pivoting action occurs due to movement of plural elements 352 about plural pivot points 354, it will be readily observed by those of ordinary skill in the art that there is generally parallel planar movement between elements 346 and 348 in the embodiment of FIG. 11. Such bladder actuation means receives an actuation force from constant force actuation means including a pair of constant force springs 356 and 358 received on respective spool support arrangements 360 and 362 mounted on planar member 348. It will be understood that the relative distal ends of springs 356 and 358 are otherwise secured to the opposing planar member 346.

While FIG. 11 illustrates an example of the location of self-adjusting component 344 being positioned closer to an end of bladder 350 than does FIG. 10 represent the placement of component 314 relative to an end of bladder 316, it will be understood that various positions of such self-adjusting components relative to their corresponding bladder may be practiced. In either case, respective principal and secondary regions (such as 318 and 320 in FIG. 10 and generally 364 and 366 of FIG. 11) are formed and operative as described during functional operations of such embodiments.

Figure 12:
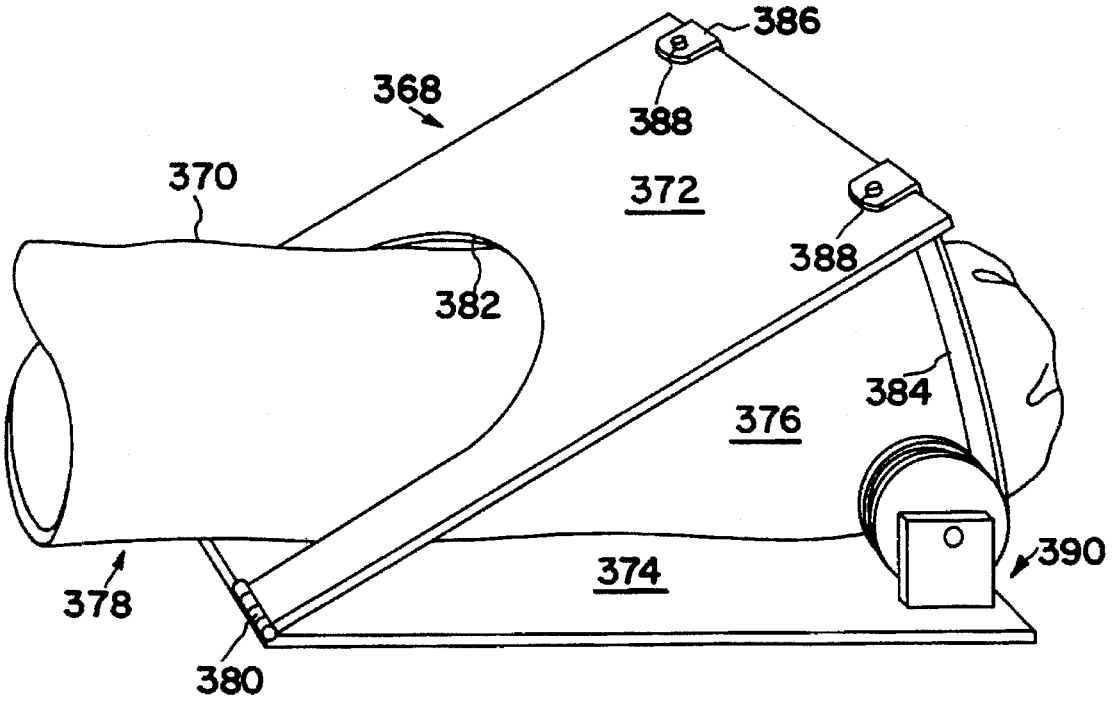
FIG. 12 is a generally enlarged, partial side perspective view of a still further exemplary embodiment of the subject invention concerning a bladder operative device.

FIG. 12 is a generally enlarged, partial side perspective view of a still further exemplary embodiment of the subject invention concerning a bladder operative device generally 368, and comprising a self-adjusting component for use with a bladder such as generally 370. Such embodiment 368 has some features similar to the embodiment of present FIG. 5 in that pivoting bladder actuation means are provided. In FIG. 12, such may comprise opposing pivoting members 372 and 374 which receive an actuation force from constant force actuation means, tending to compress a secondary region generally 376 of bladder 370 in opposition to fluid flowing into such region as pressure is otherwise applied to bladder 370 in principal region generally 378 thereof. Members 372 and 374 may be joined such as by pivot connection members 380. Unlike the FIG. 5 arrangement made for a reservoir, an opening such as 382 may be provided in one of the opposing members 372 and 374, to permit introduction of bladder 370 between such members through the end thereof adjacent to the pivot connection 380.

Preferably a pair of constant force springs 384 and 386 are secured such as with elements 388 to a pivoting end of member 372, and otherwise secured with spool supports generally 390 to the opposite member 374. With such an arrangement, those of ordinary skill in the art will understand that the potential energy of springs 384 and 386 may be utilized to direct a generally constant force to the secondary region 376 of bladder 370, whereby a generally constant predetermined internal pressure is maintained in such bladder responsive to changing patient loading thereon.

Figure 13:
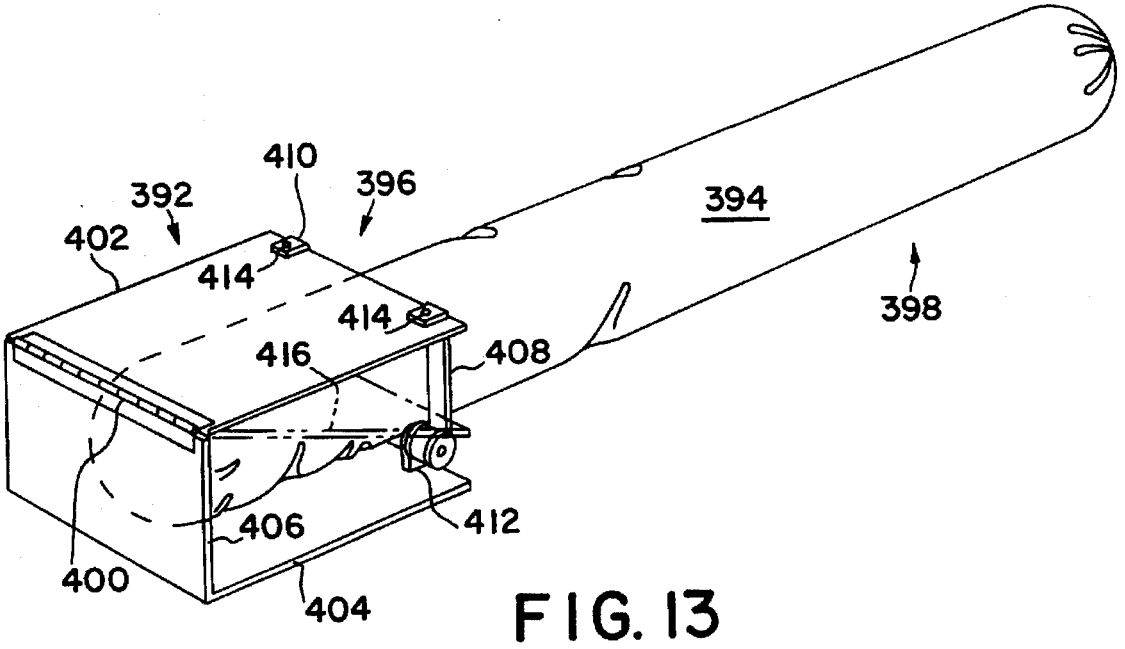
FIG. 13 is a generally side perspective view of yet a further exemplary embodiment of a bladder operative device, in accordance with the subject invention.

FIG. 13 represents a generally side perspective view of a still further exemplary embodiment of a bladder operative device generally 392 in accordance with the subject invention. The self-adjusting component 392 is operative with bladder 394 so as to segregate same primarily into a secondary region 396 and principal region 398, as additionally described above in conjunction with other embodiments. A pivot connection arrangement 400 is provided for permitting movement of opposing generally planar elements 402 and 404 so that an actuation force is transmitted to secondary region 396 of bladder 394. However, an offset member 406 is interjected in this particular embodiment between members 402 and 404, so that region 396 enters the open end of the pivoting arrangement, rather than passing through one of the planar elements (such as through opening 382 of present FIG. 12).

Again, preferably a pair of constant force springs 408 and 410 are provided with a pair of spool support arrangements 412 received on one of the members, such as planar element 404. Connecting elements, such as bolts or the like 414 otherwise secure distal or draw off ends of springs 408 and 410 to planar member 402, as shown in solid line in FIG. 13. A dotted line position 416 is illustrated for planar member 402, representing the compressive forces applied by the net interaction of self-adjusting component 392 with secondary region 396 of bladder 394. A portion of such secondary region 396 is also illustrated in dotted line in FIG. 13, so as to more clearly show the position thereof within component 392, which would be otherwise visually obscured by the perspective view shown.

As with other embodiments, those of ordinary skill in the art should continue to appreciate and understand that the relative sizes of the fluid chamber 394, as well as the respective regions 396 and 398 thereof, may be varied, as may be the spring force of springs 408 and 410, and as may be the amount of fluid received within bladder 394. Other variations are to be understood. For example, hinge arrangement 400 may be provided with a spring biased hinge arrangement, tending to force element 402 to pivot towards element 404, generally in the same manner as instead accomplished by springs 408 and 410. All such variations in the embodiment of FIG. 13, and other like variations in the other embodiments herewith, are intended to come within the spirit and scope of the present invention.

Figure 14:
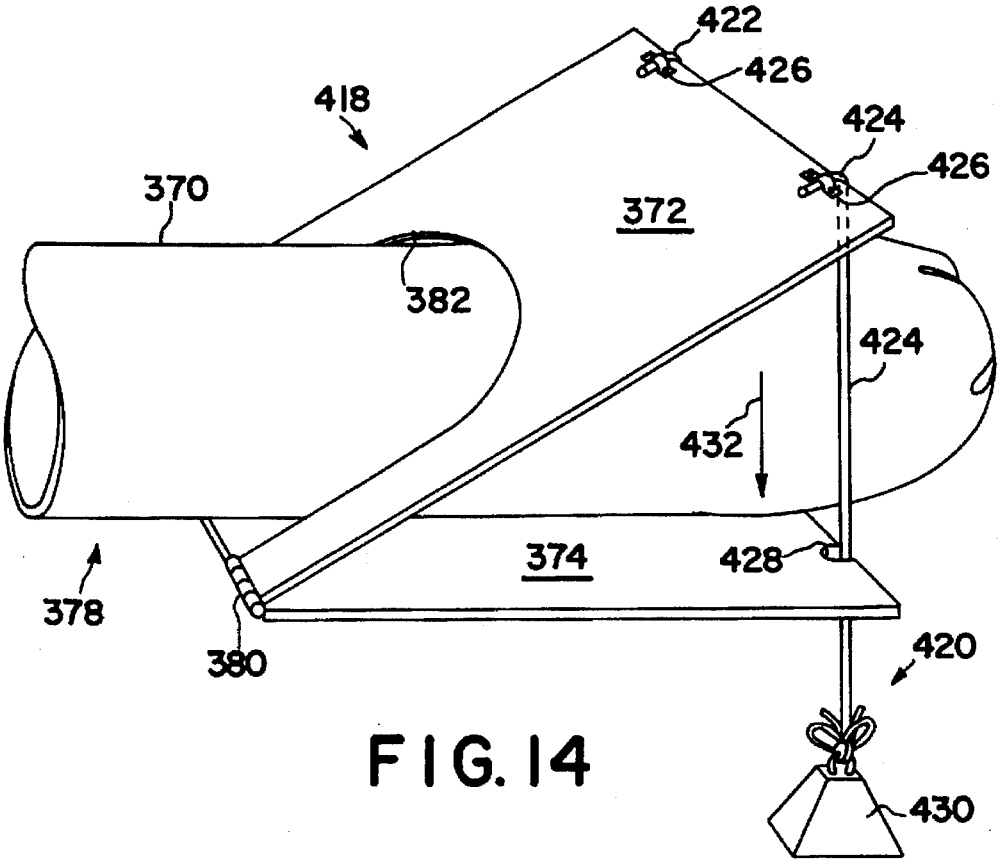
FIG. 14 is a generally enlarged, partial side perspective view similar to that of present FIG. 12 and concerning a further alternate exemplary embodiment of a bladder operative device utilizing a counterweight arrangement, in accordance with the subject invention.

FIG. 14 is a generally enlarged, partial side perspective view similar to that of present FIG. 12 and concerning a further alternative exemplary embodiment of a bladder operative device generally 418 in accordance with the subject invention. The relationship of FIG. 14 to FIG. 12 is similar to the relationship between earlier described respective FIGS. 7 and 5, in that FIG. 14 represents use of a counterweight arrangement generally 420 as a means for providing constant force actuation, instead of the use of springs 384 and 386 as represented in FIG. 12. In the interest of brevity, reference characters from FIG. 12 are repeated herein for like or corresponding elements of the embodiment of FIG. 14, without further discussion thereof.

Instead of a pair of springs, a pair of connecting members or lines 422 and 424 are respectively attached by securement features 426 to a distal or pivoting end of member 372. Openings, eyelets or similar guide elements 428 may be provided in member 374 (similar to opening 246 in member 184 of FIG. 7) by which the paired connecting members 422 and 424 may be connected with a pair of weights 430 (only one of which is seen in the view of FIG. 14). Those of ordinary skill in the art will readily understand and appreciate the various operations and functions of the embodiment of FIG. 14, including the fact that the applied actuation force acts generally in the direction of arrow 432. Since the self-adjusting component 418 of FIG. 14 is gravity dependent, it is readily apparent that the orientation illustrated is a required orientation for use of such embodiment. On the other hand, the spring actuated or otherwise non-gravity oriented actuation devices disclosed or suggested in this specification, need not necessarily be maintained in a specific orientation for practice thereof.

Figure 15:
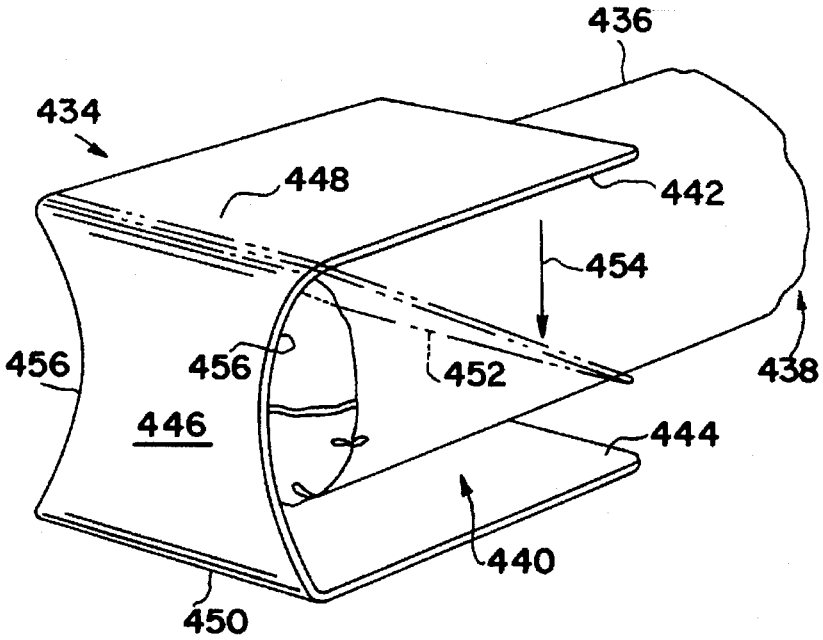
FIG. 15 is a generally enlarged, partial side and end perspective view of a still further exemplary alternative embodiment of a bladder operative device in accordance with the subject invention.

FIG. 15 is a generally enlarged, partial side and end perspective view of a still further exemplary alternative embodiment of a bladder operative device generally 434 in accordance with the subject invention. As with other of the embodiments beginning with FIG. 10, a bladder generally 436 is effectively segregated by self-adjusting component 434 into a principal region generally 438 and a secondary region generally 440, for the support purposes earlier described.

In the embodiment of component 434, bladder actuation means may comprise the opposing members 442 and 444, while the constant force actuation means operative therewith may comprise the inherent resiliency of the interconnecting backbone 446 and the integral junctures generally 448 and 450. While a solid line position is shown for element 442 in present FIG. 15, with the bladder 436 correspondingly fully inflated, a dotted line representation 452 thereof is shown to illustrate operative interaction of the constant force response means comprising self-adjusting component 434 for automatically adjusting bladder 436 using the potential energy of the inherently resilient backbone arrangement 446.

Those of ordinary skill in the art will also understand and appreciate that illustration of flexure of only region 448 (as opposed to both regions 448 and 450) implies that planar member 440 is secured against relative movement. If backbone element 446 were instead so secured, then there would be a possibility that flexure would occur at both regions 448 and 450. In either event, it will be understood that application of inward force (such as generally in the direction of arrow 454) provides a desired compressive force to bladder 436 in accordance with the subject invention, as otherwise discussed in relation to prior illustrated embodiments.

Another aspect of the subject invention represented in present FIG. 15 relates to the respective curvatures 456 formed on either lateral side of backbone 446 between juncture regions 448 and 450. As will be understood by those of ordinary skill in the art, the size and shape of such curvatures (or other non-straight line sides) affects the inherent resiliency of backbone 46 and flexure regions 448 and 450. As referenced generally above, certain embodiments of the subject invention may make use of deliberately nonlinear actuation forces so as to compensate for any nonlinearity in the bladder actuation means (or in the reservoir actuation means of other embodiments). Adjustment of such curvatures 456 is one example of compensating effects which may be introduced, just as in the case of the discussion of cut out sections 112 in earlier linear spring embodiments (see also FIGS. 1A and 2B and related discussion thereof).

Figure 16A:
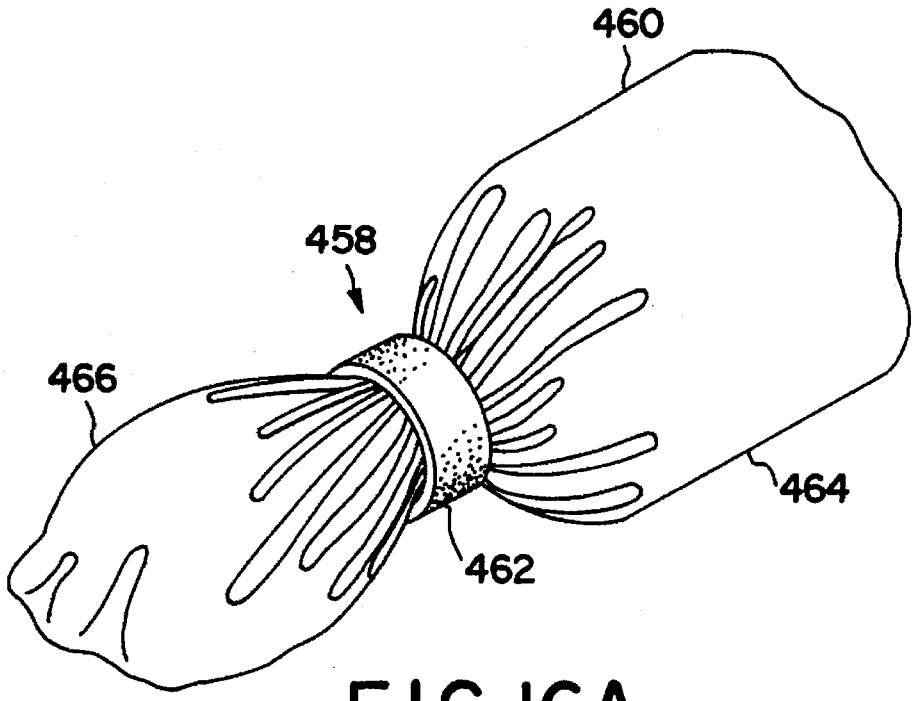
FIG. 16A is a generally enlarged, partial side and end perspective view of yet another exemplary alternative embodiment of a bladder operative device in accordance with the subject invention, representing an elastic member in a relatively contracted position about such bladder.
Figure 16B:
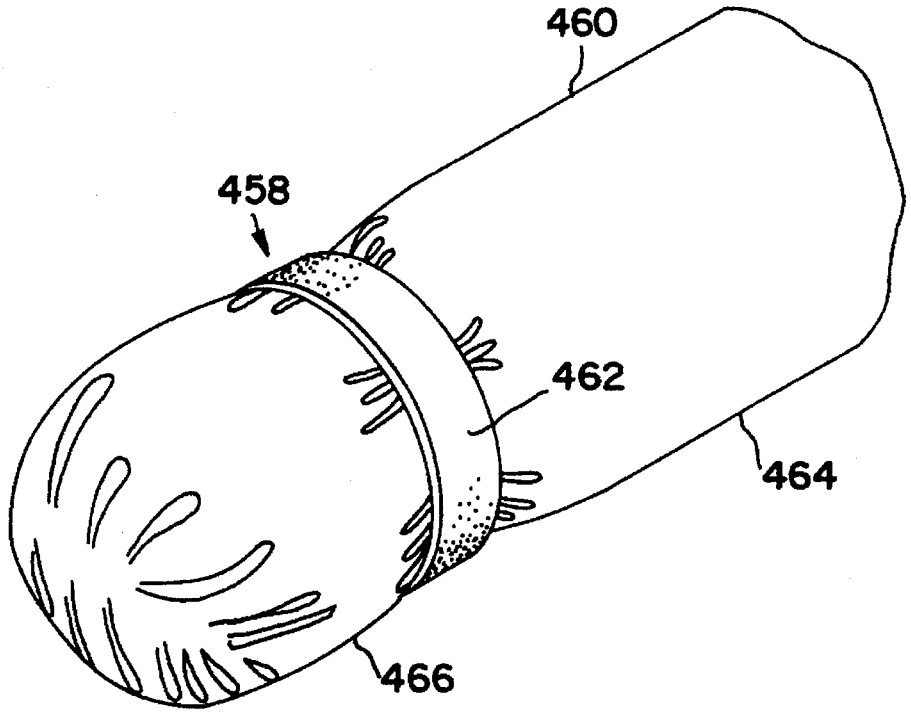
FIG. 16B is a generally enlarged, partial side and end perspective view of yet another exemplary alternative embodiment of a bladder operative device in accordance with the subject invention as in FIG. 16A, representing an elastic member in a relatively expanded condition about such bladder.

FIG. 16A is a generally enlarged, partial side and end perspective view of yet another exemplary alternative embodiment of a bladder operative device generally 458 in accordance with the subject invention. Such embodiment represents use of an elastic member 462 which is illustrated in a relatively contracted position about a bladder generally 460. FIG. 16B is a representation similar to that of present FIG. 16A concerning self-adjusting component 458, and representing such elastic member 462 in a relatively expanded condition about bladder generally 460.

Taken together, FIGS. 15 and 16A/16B represent use of a resilient member as Constituting constant force actuation means in accordance with the subject invention for directly imparting a force to a corresponding fluid support bladder tending to push fluid from a secondary region thereof to a principal region for support of a patient or for performing other desired functions. More particularly, resilient member 462 may comprise an elastic band of the like, the strength and size of which may be selected as appropriate. In the exemplary embodiment herewith, a band approximately 2 inches wide, and providing a regularly inward compressive force of anywhere from 1 to 10 pounds may be appropriate for given embodiments, depending on the initial amount of fluid contained in such bladder and the size thereof, as will be understood by those of ordinary skill in the art within the broader teachings of the subject invention.

Regardless of specific dimensions or force ratings utilized, bladder 460 is generally segregated by self-adjusting component 458 into a principal region generally 464 and a secondary region generally 466. As will be understood, FIG. 16A represents a relatively unloaded condition of principal region 464, thus permitting elastic band 462 to become substantially contracted, primarily resulting in the displacement of fluid from region 466 towards region 464. On the other hand, FIG. 16B generally represents a more fully loaded condition of region 464, resulting in a relatively expanded condition of elastic band 462. Multiple bands may be used per bladder in some embodiments. As with other embodiments, the self-adjusting component 458 may be practiced in conjunction with various fluid support bladder arrangements and/or in combination with other self-adjusting components in accordance with the subject invention.

As referenced above, some embodiments of the subject invention are particularly well suited for practice in conjunction with a support arrangement generally as configured in accordance with the disclosure of U.S. Pat. No. 5,070,560, the disclosure of which is otherwise fully incorporated herein by reference. For example, FIG. 1 of U.S. Pat. No. 5,070,560 shows in the foreground thereof partially exposed (by cutaway view) plural longitudinal air cylinders, which in accordance with the subject invention may be either originally outfitted or retrofit with various features of the subject invention for practice thereof. The following discussion of FIGS. 17A through 17C represent one exemplary such arrangement for either inclusion during original production or potentially for retrofit.

Figure 17A:
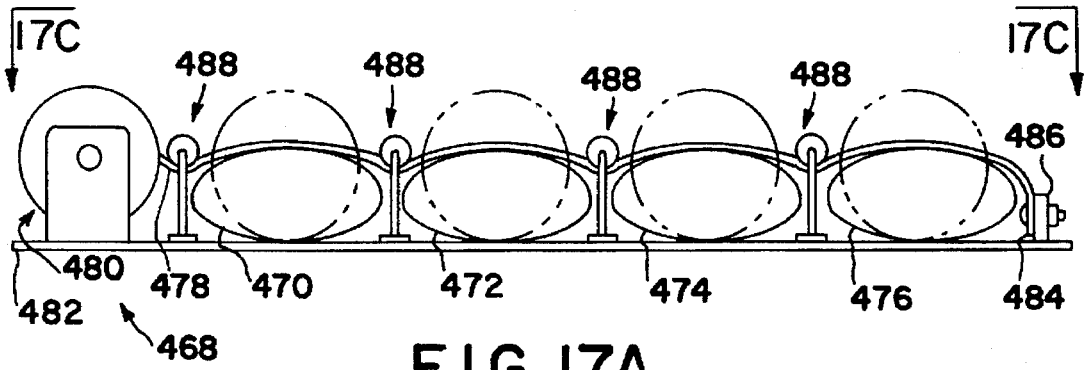
FIG. 17A is a generally end elevational view of a still further embodiment of a bladder operative device and a support system arrangement in accordance with the subject invention, illustrating a plurality of bladders in generally relatively compressed state.

FIG. 17A is a generally end elevational view of such further embodiment of a bladder operative device generally 468 in accordance with the subject invention, illustrating in solid line a plurality of longitudinal parallel bladders generally in relatively compressed state. FIG. 17B is a view similar to that of the embodiment of component 468, illustrating the represented plurality of bladders thereof in generally relatively expanded state. FIG. 17C is a partial, generally top elevational view of the present embodiment of component 468 of FIG. 17A, as indicated by view line 17C—17C thereof.

Figure 17B:
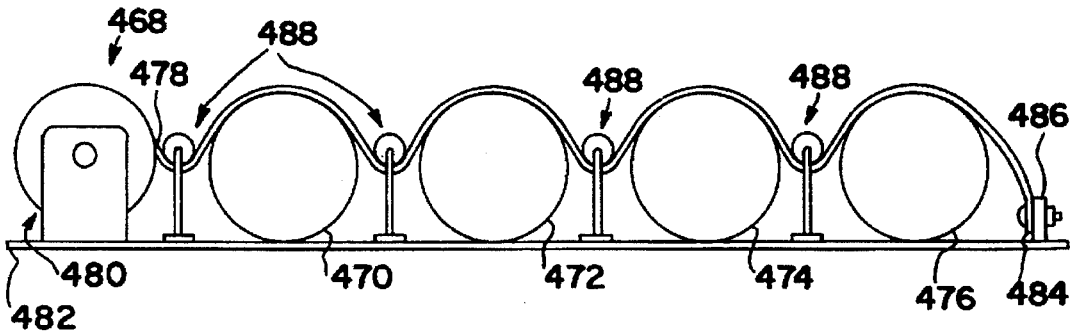
FIG. 17B is a generally end elevational view of a still further embodiment of a bladder operative device and a support system arrangement in accordance with the subject invention as in FIG. 16A, illustrating a plurality of bladders in generally relatively expanded state.
Figure 17C:
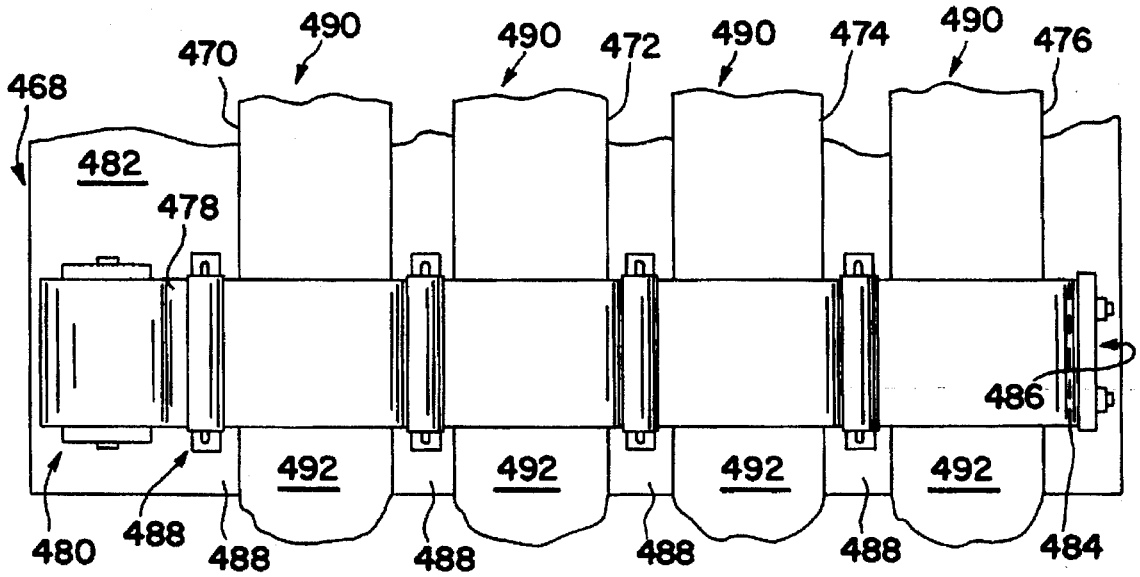
FIG. 17C is a partial, generally top elevational view of the present embodiment of FIG. 17A, as indicated by view line 17C—17C therein.

It is intended that FIGS. 17A through 17C represent a support arrangement wherein a plurality of bladders are operated in accordance with the subject invention in conjunction with a single constant force actuation means, but nonetheless relatively independently capable of being adjusted thereby.

Specifically, bladders 470, 472, 474, and 476 comprise longitudinal chambers (such as cylinders) disposed generally in parallel to one another and longitudinally along a mattress, mattress overlay, or mattress replacement, such as arranged in U.S. Pat. No. 5,070,560. As represented, the plurality of fluid support bladders are arranged so that preferably they do not contact one another during various loading conditions. Such fact contributes to their ability to independently react. While such bladders 470, 472, 474, and 476 may be provided with a plurality of respective self-adjusting components in accordance with the invention, as represented by present FIGS. 2A and 2B, the single self-adjusting component 468 may be utilized as follows.

A single constant force spring generally 478 may be supported on a spool arrangement generally 480 supported on a main support element 482. As was represented and discussed in conjunction with present FIGS. 9A and 9B, a flexible webbing may be alternately utilized in conjunction with drawing off of such constant force spring 478 (though not specifically illustrated in present FIGS. 17A through 17C). Whenever such flexible webbing is not utilized, a distal end 484 of constant force spring 478 is otherwise secured with connector element 486 to main support board 482. Rivets, bolts, screws, welds, or similar connecting features may be utilized. Whenever a flexible webbing is utilized, the distal end 484 of constant force spring 478 is otherwise connected to board 482 with connecting member 486 through such flexible webbing.

As represented, a containment element, such as a rotatably mounted cylindrical member generally 488, is received between each adjacent pair of fluid support bladders, and between the spool support and the fluid support bladder adjacent thereto. With such an arrangement, either the flexible webbing or the constant force spring 478 itself is interlaced so as to pass under each of such containment members 488, but over the upper surfaces of the respective support bladders, 470, 472, 474, and 476. It should be understood that the relative interlacing would be reverse if the non-gravity based embodiment 468 were used in a position upside down relative to that shown.

With the arrangement of FIGS. 17A through 17C, compressive forces are applied to each of such bladders by the single constant force spring 478. At the same time, expanding movement (i.e., force) of any respective bladder greater than the compressive force exerted thereon will cause the constant force spring 478 to be drawn further off its support spool arrangement 480, since the opposite or distal end 484 of spring 478 is otherwise secured. Generally speaking, such occurrence will continue until an equilibrium point is realized, as with other embodiments. Also, generally speaking, the equilibrium point being maintained for one bladder will not significantly effect the equilibrium points being maintained for other bladders (so long as friction forces are maintained at a minimum).

As will be readily apparent to those of ordinary skill in the art, the arrangement of a self-adjusting component generally 468 also serves to segregate each respective bladder into relative principal regions generally 490 thereof and relatively secondary regions generally 492 thereof (see FIG. 17C), the significance of which has been discussed above in conjunction with prior illustrated embodiments. It will also be understood that the arrangement of present FIGS. 17A through 17C may be practiced with fewer or greater number of bladders used with component 468. For example, the constant force spring of a self-adjusting component 468 may be provided passing over two bladders from one lateral side thereof (such as bladders 470 and 472) while a similar self-adjusting component 468 may be provided on the opposite lateral side for having the constant force spring thereof passing over and being operative with bladders 474 and 476.

Figure 18:
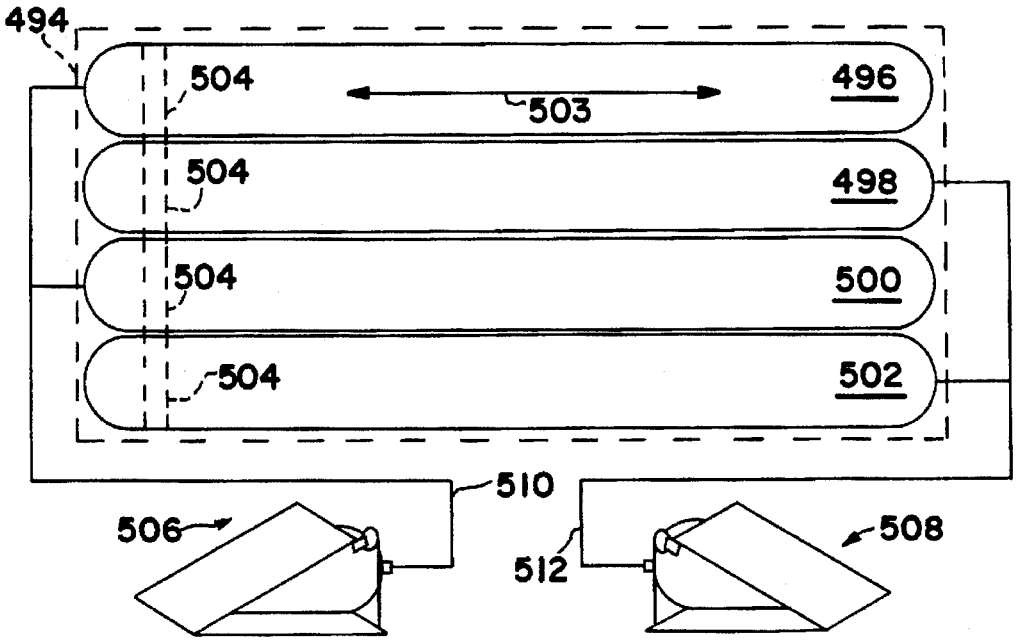
FIG. 18 is a diagrammatic representation of an alternative embodiment of a support arrangement in accordance with the subject invention, representing various mattress and seating alternative arrangements, and others, in accordance with this invention.
Figure 19:
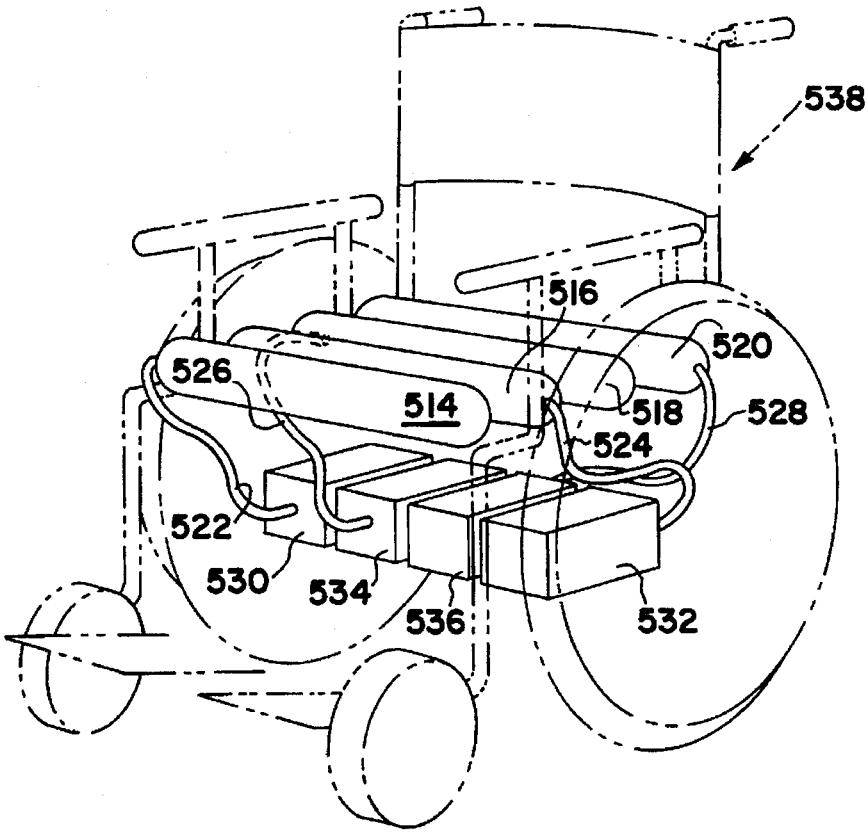
FIG. 19 is a generally side and front perspective view of a still further alternative support arrangement in accordance with the current invention, representing potential wheelchair use thereof in dotted lines.
Figure 20:
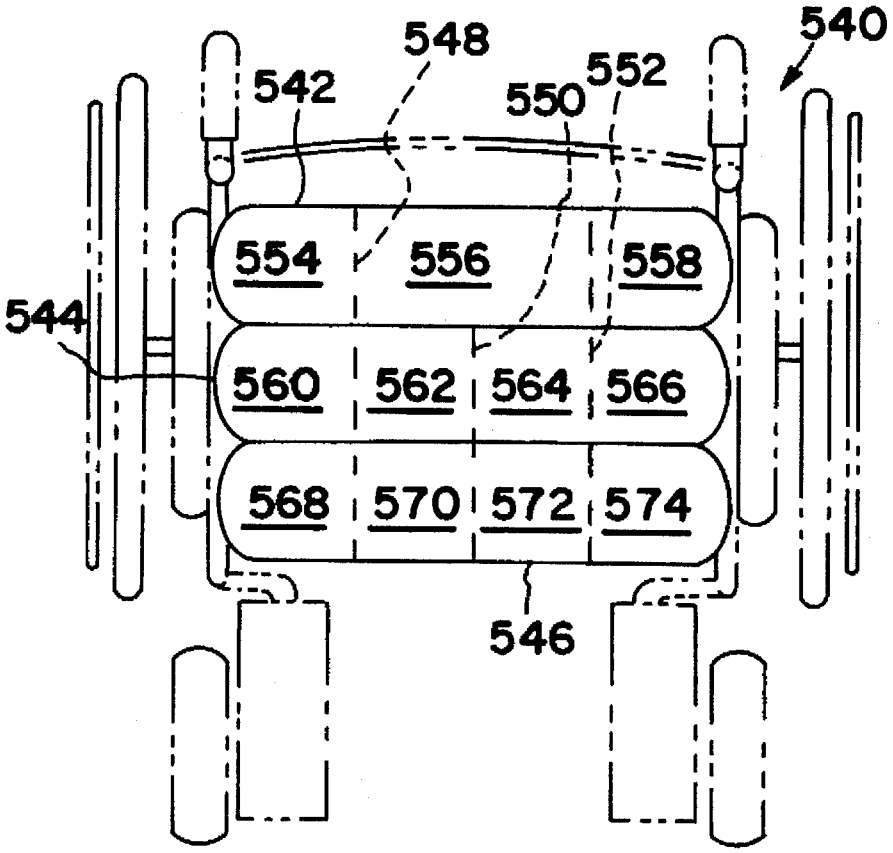
FIG. 20 is a generally top elevational view of a still further exemplary embodiment of a support arrangement in accordance with the subject invention, particularly representing a further wheelchair or other patient care arrangement.

FIGS. 18 through 20 represent additional modifications and variations of support arrangements and corresponding methodologies which may be practiced in accordance with the subject invention. In particular, FIG. 18 is a diagrammatic representation of broader concepts of support arrangements which may be practiced in accordance with the subject invention, representing various mattress and seating alternative arrangements, and others. FIG. 19 is a generally side and front perspective view of an alternative support arrangement representing potential wheelchair use (in dotted lines). FIG. 20 is generally a top elevational view of a still further exemplary embodiment of a support arrangement in accordance with this invention, particularly concerning a further wheelchair or similar patient care arrangement.

In a broad sense, FIG. 18 diagrammatically represents in dotted line a main support body 494 which may be provided in accordance with the invention. Such main support body has a predetermined arrangement of independently adjustable fluid chambers therein. In the particular embodiment shown (for purposes of example only), four respective independent chambers 496, 498, 500, and 502 are illustrated.

The shape and size of each respective chamber defines a corresponding independently acting support section of the main support body 494.

For purposes of discussion only (and without limitation), the represented shapes and sizes of present FIG. 18 illustrate generally elongated chambers having a longitudinal axis generally 503 which runs substantially parallel with a like longitudinal axis of main support body 494. While providing such an example, it is to be clearly understood by those of ordinary skill in the art that support arrangements in accordance with the subject invention are not limited to like rectangular shapes only, but may include other geometrical shapes and sizes, as well as non-geometrical bodies for particularized support circumstances, virtually without limitation.

FIGS. 17A through 17C represent the fact that the present invention may be practiced utilizing self-adjusting components constituting essentially direct bladder operative devices. Such facet of this invention is further broadly represented by the dotted line representation in present FIG. 18 of respective resilient members (elastic bands) 504 on each of the support bladders 496, 498, 500, and 502 relatively adjacent one end of each such bladder.

Otherwise, FIG. 18 diagrammatically illustrates the use of a plurality of constant force fluid reservoir means, each being respectively in fluid communication with one or more of the respective fluid chambers, for automatically adjusting such respective chamber(s) using potential energy thereof, so as to independently maintain a generally constant predetermined internal pressure in each such respective chamber (s) responsive to changing patient loading (or other loading source changes) on the main support body 494.

In particular, diagrammatical representations of self-adjusting components generally 506 and 508 are shown in fluid communication by way of respective fluid interconnections 510 and 512. By way of example only, fluid interconnection conduit 510 branches for providing fluid communication of self-adjusting component 506 with both fluid support bladders 496 and 500. It is to be understood that self-adjusting component 506 could be interconnected with any number of the indicated bladders (including none of the bladders, if desired, to serve as an available back-up self-adjusting component to the work of the other component 508). Similarly, by way of example only, fluid interconnecting conduit 512 branches so as to interconnect exemplary self-adjusting component 508 with both fluid support bladders 498 and 502. Alternative interconnection arrangements may be utilized as just discussed.

As further represented by present FIG. 18, self-adjusting components may be provided outside of a main support body 494, or they may be incorporated thereinto, as represented in present FIGS. 2A and 2B. It is to be understood that various embodiments may also make use of added features, such as various foam support elements, as referenced above in conjunction with present FIGS. 2A and 2B.

Still further, it is to be understood that, while diagrammatic representations of self-adjusting components 506 and 508 most nearly resemble the embodiment of present FIG. 5, any variety of self-adjusting components disclosed or otherwise suggested herewith in accordance with the subject invention, capable of interconnection with a fluid passageway means, may be utilized in one or more positions for self-adjusting components used in a given support arrangement and practice of the subject invention. All such various combinations, and corresponding modifications and variations necessary to effect such combinations, are intended as being included within the spirit and scope of the present invention, including both apparatus and methodology.

It is to be recognized by those of ordinary skill in the art that the above disclosure has already made clear the possibility of utilizing in the diagrammatical representation of FIG. 18 self-adjusting components relating to bladder operative devices. It is to be further understood, however, that various embodiments of the subject invention may include combinations of various bladder operative devices with various reservoir operative devices, as may be called for in given arrangements.

FIG. 19 specifically represents potential application of certain aspects of the present invention to use in a wheelchair or other patient care seating arrangement. Specifically represented (though considerable variations may be practiced within the spirit and scope of the present invention) is an arrangement of four respective independently adjustable fluid chambers 514, 516, 518, and 520. Respective flexible fluid interconnecting conduits 522, 524, 526, and 528 interconnect such respectively adjustable chambers with corresponding plural constant force fluid reservoir means or self-adjusting components 530, 532, 534, and 536 in accordance with the subject invention. As in the case of diagrammatical representations of self-adjusting components 506 and 508 in FIG. 18, such constant force reservoir means 530, 532, 534, and 536 may comprise any of the available embodiments disclosed or otherwise suggested by the present disclosure. For example, one of the generally rectangular shaped embodiments (as shown generally by FIGS. 1A through 4) may be practiced.

A general representation in dotted line of a wheelchair 538 in FIG. 19 represents one particular predetermined arrangement which may be made, with fluid support chambers 514, 516, 518, and 520 disposed in parallel with one another and generally laterally with respect to the intended seating position of a user of wheelchair 538. For example, such an arrangement advantageously would independently help address excessive loading to the underside of the patient's upper leg(s), as might otherwise occur at the front edge of the wheelchair just above fluid support bladder 514. It will be readily understood by those of ordinary skill in the art that the size of self-adjusting components 530, 532, 534, and 536 may be relatively reduced, since the corresponding fluid support bladder size is likewise relatively reduced (for example, as compared with the larger size bladders of present FIGS. 2A and 2B).

FIG. 20 is a generally top elevational view of a still further exemplary embodiment of a support arrangement in accordance with the subject invention, particularly concerning a further arrangement which may be made for a wheelchair or similar patient care device, such as a geriatric chair. Shown in dotted line generally 540 is again a basic wheelchair representation, to illustrate relative placement of potential seating arrangements. At the same time, three fluid support bladders 542, 544, and 546 are represented, and may be provided as respective independently adjustable support sections, such as referenced above in conjunction with the discussion of FIGS. 18 and 19. However, additional dotted line separations 548, 550, and 552 are shown(running front to back of wheelchair 540), which are representative of further support section divisions which may be made. Selection of multiple zones may be made by those practicing the subject invention, and may include virtually any combination of respective or collective sections represented in present FIG. 20 as potential respective support sections 554, 556, 558, 560, 562, 564, 566, 568, 570, 572, and 574.

It will likewise be understood that multiple bladders or sacks may be so arranged, as desired, in both seating arrangements and mattress or patient support arrangements of virtually all types. In conjunction with medical products, such specialized mattresses may include mattresses themselves, or mattress overlays, or mattress replacement systems. The support systems may be specialized for X-ray, operating room, or NMR technology use. Still further, arrangements thereof may be made for intended use in either intensive care or regular care settings, including home healthcare or nursing home settings. The invention would likewise be applicable to all manner of critical care settings, as well as burn patient settings, emergency room gurneys, and ambulance stretchers.

The invention is equally applicable to all age patients, including adults, elderly patients, and infants. It is likewise applicable to further specialized care arrangements, such as tending to the special needs of amputees, or those physically challenged by birth defects or crippling injuries. Particular embodiments may also be applicable to those with temporary conditions, such as pregnancy, with progressive adjustment of the support arrangement or performance features thereof in relation to progression of the pregnancy and the recovery period thereafter.

Other customized applications may involve surgery patients and their special support needs, before, during, and after surgery.

Numerous support arrangements would likewise be applicable in the non-medical (in other words, the consumer) market place.

Still further, use of the invention would be applicable to all manner of seating arrangements (including partially reclined or angled seating arrangements such as military vehicles designed to withstand acceleration shock). Applicable seating arrangements may include wheelchairs and geriatric care chairs of all type. Consumer seating arrangements may also include ergonomic chairs (such as for office workers) and automobile or transportation vehicle seating devices of all types. In conjunction with such, there could be a particular improvement in rider comfort, especially in long term travel circumstances or otherwise rough ride circumstances such as in trucks or trains.

Practice of the present invention is also potentially advantageous in ergonomic improvements to worker environments, for example, to help reduce the likelihood or the occurrence of repetitive motion injuries, such as potentially occurring due to environment vibration or long term seating stresses.

More broadly, the invention is applicable virtually to any situation of a body in rest, or in any situation of a body receiving changing stress. In addition to human users, other fragile cargo, such as electronic components, glassware, and others, may receive benefit from specialized shipping or packaging arrangements practicing the subject invention.

Still further, it will be understood that various aspects of the embodiments discussed herein and portions thereof may be interchangeably used with the other embodiments of the subject invention. For example, constant force actuation means in accordance with the embodiments of present FIGS. 1 through 9B may be selectively interchangeably used with constant force actuation means disclosed in conjunction with the embodiments of present FIGS. 10 through 17C.

For example, the resilient member actuation means of present FIGS. 16A and 16B (utilized therein directly in conjunction with a fluid support bladder) may instead be utilized in conjunction with the application of a constant (or other) actuation force to reservoir operative devices in accordance with this invention. Similarly, the movable member arrangement of present FIG. 8 or the relative axial twisting embodiment of present FIGS. 9A/9B (both discussed in conjunction with reservoir operative devices) may be variously applied in principle to bladder operative devices herein. All such interchangeability is intended to come within the spirit and scope of the present invention.

Likewise, all alternative arrangements making use of potential energy, without necessarily requiring external energy, sensory feedback, or control of devices such as pumps, valves, or the like, are intended to come within the spirit and scope of the constant force fluid reservoir means and constant force response means herewith, as well as the self-adjusting components in accordance with the subject invention.

It should be further understood by those of ordinary skill in the art that the forgoing presently preferred embodiments are exemplary only and that the attendant description thereof is likewise by way of words of example rather than words of limitation and their use does not preclude inclusion of such modifications, variations, and/or additions to the present invention, as would be readily apparent to one of ordinary skill in the art, the scope of the present invention being set forth in the appended claims.

What is claimed is:

1. A self-adjusting pressure relief patient support apparatus, comprising:

a main support body for receiving a patient thereon, and having at least one adjustable fluid support bladder with fluid therein; and constant force fluid reservoir means, in fluid communication with said fluid support bladder, resiliently actuated for automatically adjusting said bladder using potential energy so as to maintain a generally constant predetermined internal pressure in said bladder responsive to changing patient loading on said main support body;

wherein said fluid reservoir means includes a fluid reservoir and fluid passageway means for interconnecting said reservoir in sealed fluid communication with said support bladder, and wherein said support bladder comprises a fluid sealable membrane adapted to be variably compressed by the interaction of elements therewith; and further wherein said fluid reservoir means further includes constant force actuation means including a resilient member for imparting a imparting a force directly to said reservoir tending to push fluid from said fluid reservoir into said fluid passageway means and towards said support bladder.

2. An apparatus as in claim 1, wherein said reservoir comprises a variable volume chamber for holding fluid.

3. An apparatus as in claim 2, wherein said reservoir comprises a fluid sealable membrane adapted to be variably compressed by the action of elements pressing thereon.

4. An apparatus as in claim 1, wherein said fluid passageway means comprises a fluid port formed with said fluid reservoir and an interconnecting conduit associated with said port.

5. An apparatus as in claim 4, wherein said conduit comprises flexible tubing.

6. An apparatus as in claim 1, said fluid reservoir means further including reservoir actuation means, responsive to an actuation force applied thereto for acting on said reservoir with a force tending to push fluid from said fluid reservoir into said fluid passageway means and towards said support bladder.

7. An apparatus as in claim 6, wherein said reservoir actuation means comprises at least two members, relatively movable with respect to each other and mutually cooperative for transmitting said actuation force to said reservoir.

8. An apparatus as in claim 6, wherein said fluid reservoir means further includes constant force actuation means for applying said actuation force to said reservoir actuation means, said actuation force being at least a generally constant force.

9. An apparatus as in claim 7, wherein said at least two members comprise a pair of relatively planar elements.

10. An apparatus as in claim 9, wherein said planar elements are received for relative planar movement parallel to each other with said reservoir received therebetween so as to receive a varying compressive force depending on the degree of parallel movement of said planar elements.

11. An apparatus as in claim 10, wherein said reservoir actuation means further includes at least one guide channel with at least one of said planar elements received therein for movement therealong.

12. An apparatus as in claim 9, wherein said planar elements are received for pivoting movement relative to each other with said reservoir receive therebetween so as to receive a varying compressive force depending on the degree of pivoting movement of said planar elements.

13. An apparatus as in claim 7, wherein said at least two members are received for axial twisting movement relative to each other with said reservoir secured therebetween so as to receive a varying torsional force depending on the degree of twisting movement of said at least two members.

14. An apparatus as in claim 7, wherein said at least two members are integrally associated with said reservoir so as to form part of said reservoir.

15. An apparatus as in claim 14, wherein said two members comprise opposing end plates received against otherwise open ends of said reservoir for sealing same, said end plates being alternately movable in relative planar parallel movements to each other so as to variably compress said reservoir therebetween depending on the degree of parallel movement of said two members, and further wherein at least one of said end plates includes a port for fluid interconnection of said reservoir with said fluid passageway means.

16. An apparatus as in claim 7, wherein said two members include one support member with said reservoir supported thereon and one movable member movable relative to said support member for engaging said reservoir between said two members so as to transmit said actuation force to said reservoir.

17. An apparatus as in claim 16, wherein said support member comprises a generally planar member with opposing ends of said reservoir secured thereon and with a fluid port formed relatively adjacent one of such reservoir ends and in fluid communication with said fluid passageway means, and further wherein said movable member comprises a generally cylindrical member mounted intermediate said reservoir opposing ends for movement therebetween in engagement with said reservoir such that fluid in said reservoir may be forced towards said reservoir fluid port by movement of said movable member towards said reservoir fluid port.

18. An apparatus as in claim 1, wherein said resilient member comprises at least one elastic band received about a portion of said reservoir.

19. An apparatus as in claim 1, wherein said resilient member comprises a resilient clip with opposing legs placed in contact with at least a portion of said reservoir so as to impart a squeezing force thereto.

20. An apparatus as in claim 1, wherein said main support body includes a plurality of fluid support bladders with fluid therein and commonly interconnected with said fluid reservoir by said fluid passageway.

21. An apparatus as in claim 1, wherein:

said main support body includes a plurality of fluid support bladders with fluid therein; and said fluid reservoir means includes a corresponding plurality of reservoirs respectively interconnected with said plurality of bladders by said fluid passageway means, and further includes a corresponding plurality of reservoir actuation means, responsive to an actuation force applied thereto for independently acting on a corresponding one of said reservoirs with a force tending to push fluid from such fluid reservoir into said fluid passageway means and towards a support bladder respectively interconnected with such reservoir.

22. An apparatus as in claim 1, wherein said fluid comprises a gas.

23. An apparatus as in claim 22, wherein said gas is air.

24. An apparatus as in claim 1, wherein said fluid comprises a liquid.

25. An apparatus as in claim 1, wherein said fluid comprises a relatively viscous fluid.

26. An apparatus as in claim 1, wherein said main support body comprises one of a mattress, a matterss overlay, and a mattress replacement with a plurality of adjustable support bladders with fluid therein.

27. An apparatus as in claim 26, wherein said fluid reservoir means includes a plurality of fluid reservoirs, each respectively and operatively associated with one of said plurality of fluid support bladders.

28. An apparatus as in claim 26, wherein said fluid reservoir means includes a plurality of fluid reservoirs, each respectively and operatively associated with a predetermined plurality of said plurality of fluid support bladders.

29. A self-adjusting pressure relief patient support apparatus, comprising:

a main support body for receiving a patient thereon, and having at least one adjustable fluid support bladder with fluid therein; and constant force fluid reservoir means, in fluid communication with said fluid support bladder, for automatically adjusting said bladder using potential energy so as to maintain a generally constant predetermined internal pressure in said bladder responsive to changing patient loading on said main support body; wherein said main support body includes at least two respective adjustable fluid support bladders with fluid therein;

said constant force fluid reservoir means includes at least two respective corresponding fluid reservoirs and corresponding respective fluid passageway means for respectively interconnecting said respective reservoirs in sealed fluid communication with corresponding respective support bladders;

said fluid reservoirs comprise respective fluid sealable membranes adapted to be variably compressed by the action of elements pressing thereon, and having respective fluid ports therein for connection with said fluid passageway means;

said fluid passageway means comprise respective interconnecting conduits respectively associated with said respective fluid ports and said corresponding respective support bladders; and wherein said fluid reservoir means further includes reservoir actuation means, responsive to an actuation force applied thereto for acting on said reservoir with a force tending to push fluid from said fluid reservoir into said fluid passageway means and towards said support bladder, and wherein said reservoir actuation means comprises at least three members, relatively movable with respect to each other and with associated ones of said respective support bladders received between two relative pairs of such three members, such that actuation force applied to a respective pair is transmitted to its respective associated support bladder received therebetween.

30. An apparatus as in claim 29, wherein said relative pairs of members are received in stacked array for relative planar movement parallel to each other.

31. An apparatus as in claim 29, wherein said relative pairs of members are received in stacked array for respective pivoting movement relative to each other.

32. A self-adjusting pressure relief patient support apparatus, comprising:

a main support body for receiving a patient thereon, and having at least one adjustable fluid support bladder with fluid therein; and constant force fluid reservoir means, in fluid communication with said fluid support bladder, for automatically adjusting said bladder using potential energy so as to maintain a generally constant predetermined internal pressure in said bladder responsive to changing patient loading on said main support body;

wherein said fluid reservoir means includes a fluid reservoir and fluid passageway means for interconnecting said reservoir in sealed fluid communication with said support bladder;

said fluid reservoir means further including reservoir actuation means, responsive to an actuation force applied thereto for acting on said reservoir with a force tending to push fluid from said fluid reservoir into said fluid passageway means and towards said support bladder;

wherein said fluid reservoir means further includes constant force actuation means for applying said actuation force to said reservoir actuation means, said actuation force being at least a generally constant force; and wherein said constant force actuation means includes at least one constant force spring associated with said reservoir actuation means so as to apply said actuation force thereto.

33. An apparatus as in claim 32, wherein said constant force actuation means further includes a flexible webbing interconnecting between at least one constant force spring and said reservoir actuation means.

34. An apparatus as in claim 32, wherein said constant force actuation means further includes a second constant force spring operative in tandem with said at least one constant force spring for applying said actuation force to said reservoir actuation means.

35. A self-adjusting pressure relief patient support apparatus, comprising:

a main support body for receiving a patient thereon, and having at least one adjustable fluid support bladder with fluid therein; and constant force fluid reservoir means, in fluid communication with said fluid support bladder, for automatically adjusting said bladder using potential energy so as to maintain a generally constant predetermined internal pressure in said bladder responsive to changing patient loading on said main support body;

wherein said fluid reservoir means includes a fluid reservoir and fluid passageway means for interconnecting said reservoir in sealed fluid communication with said support bladder;

said fluid reservoir means further including reservoir actuation means, responsive to an actuation force applied thereto for acting on said reservoir with a force tending to push fluid from said fluid reservoir into said fluid passageway means and towards said support bladder;

wherein said fluid reservoir means further includes constant force actuation means for applying said actuation force to said reservoir actuation means, said actuation force being at least a generally constant force; and wherein said constant force actuation means includes a counterweight arrangement associated with said reservoir actuation means so as to apply said actuation force thereto.

36. A self-adjusting pressure relief patient support apparatus, comprising:

a main support body for receiving a patient thereon, and having at least one adjustable fluid support bladder with fluid therein; and constant force fluid reservoir means, in fluid communication with said fluid support bladder, resiliently actuated for automatically adjusting said bladder using potential energy so am to maintain a generally constant predetermined internal pressure in said bladder responsive to changing patient loading on said main support body;

wherein said main support body comprises a seating arrangement for a user with a plurality of adjustable support bladders with fluid therein.

37. A pressure relief support arrangement for a mattress for automatically optimizing pressure dispersion for a person received thereon, without requiring sensory feedback or pump control systems, said arrangement comprising:

a plurality of elongated fluid chambers with fluid therein, disposed generally in parallel and having respective individual fluid ports providing a fluid passageway between the interior and exterior of each respective chamber;

a main support body for receiving and generally maintaining said plurality of fluid chambers in a predetermined arrangement relative to each other;

a plurality of fluid conduits respectively interconnected in fluid sealed relationship with each of said chamber fluid ports for permitting fluid to be controllably transmitted alternately into and out of each respective fluid chamber; and constant force fluid reservoir means, in fluid communication with said plurality of fluid conduits, resiliently actuated for automatically adjusting the amount of fluid within each of said fluid chambers, using potential energy without requiring use of any sensory feedback or pump control systems, so as to maintain generally constant predetermined fluid pressure within the interiors of said fluid chambers responsive to respective loading changes on said plurality of fluid chambers.

38. An arrangement as in claim 37, wherein said fluid reservoir means includes at least one variable volume fluid reservoir and a fluid port therein connected with at least one of said fluid conduits for interconnecting said reservoir in sealed fluid communication with selected ones of said elongated fluid chambers.

39. An arrangement as in claim 38, wherein said fluid reservoir means further includes reservoir actuation means, responsive to an actuation force applied thereto for acting on said reservoir with a force tending to push fluid from said fluid reservoir into a corresponding fluid conduit and towards a corresponding fluid chamber, said reservoir actuation means comprising at least two members, relatively movable with respect to each other and mutually cooperative for transmitting said actuation force to said reservoir.

40. An arrangement as in claim 39, wherein said at least two members comprise a pair of relatively planar elements, received for relative planar movement parallel to each other with said reservoir received therebetween so as to receive a varying compressive force depending on the degree of parallel movement of said planar elements.

41. An arrangement as in claim 40, wherein said reservoir actuation means further includes a pair of relatively low friction slide channels with at least one of said planar elements received wherein for guided movement therealong.

42. An arrangement as in claim 39, wherein said two members are received for one of pivoting movement relative to each other and axial twisting movement relative to each other with said reservoir received therebetween so as to receive a varying force depending on the degree of movement of said two members.

43. An arrangement as in claim 39, wherein said two members comprise opposing end plates received against otherwise open ends of said reservoir for sealing same, said end plates being alternately movable in relative planar parallel movements to each other so as to variably compress said reservoir therebetween depending on the degree of parallel movement of said two members, and further wherein at least one of said end plates includes a port for fluid interconnection of said reservoir with said fluid conduit.

44. An arrangement as in claim 39, wherein one of said two members comprises a generally planar support member with opposing ends of said reservoir secured thereon and with a fluid port formed relatively adjacent one of such reservoir ends and in fluid communication with said fluid conduit, and further wherein the other of said two members comprises a generally cylindrical movable member mounted intermediate said reservoir opposing ends for movement therebetween in engagement with said reservoir such that fluid in said reservoir may be forced towards said reservoir fluid port by movement of said movable member towards said reservoir fluid port.

45. An arrangement as in claim 39, wherein said fluid reservoir means further includes constant force actuation means for applying said actuation force to said reservoir actuation means, said actuation force being at least a generally constant force.

46. An arrangement as in claim 45, wherein said constant force actuation means includes at least one constant force spring associated with said reservoir actuation means so as to apply said actuation force thereto.

47. An arrangement as in claim 46, wherein said constant force actuation means further includes a second constant force spring operative in tandem with said at least one constant force spring for applying said actuation force to said reservoir actuation means.

48. An arrangement as in claim 37, wherein:

said main support body includes at least two respective adjustable elongated fluid chambers with fluid therein, and a resilient foam body at least partially enclosing and covering said chambers so as to form a user receiving surface thereover; and said constant force fluid reservoir means includes at least two respective corresponding fluid reservoirs associated with corresponding respective fluid conduits respectively interconnecting said respective reservoirs in sealed fluid communication with corresponding respective elongated fluid chambers.

49. An arrangement as in claim 48, wherein:

said main support body houses four of said elongated fluid chambers therein disposed in parallel and directed longitudinally along said main support body intended for generally longitudinal alignment with a user received thereon; and said constant force fluid reservoir means includes four corresponding fluid reservoirs associated respectively with said four fluid chambers through a corresponding number of said fluid conduits.

50. An arrangement as in claim 49, wherein said four fluid reservoirs and corresponding automatic adjustment features thereof of said constant force fluid reservoir means are further housed generally within said main support body.

51. A sectionalized support arrangement with multiple independently acting support sections, comprising:

a main support body having a predetermined arrangement of independently adjustable fluid chambers therein with fluid in such chambers, and with the shape and size of each chamber defining a corresponding independently acting support section; and a plurality of constant force fluid reservoir means, each being respectively in fluid communication with a respective one of said fluid chambers, resilently acuated for automatically adjusting such respective one chamber using potential energy so as to independently maintain a generally constant predetermined internal pressure in such respective one chamber responsive to changing patient loading on said main support body.

52. A sectionalized support arrangement as in claim 51, wherein said fluid reservoir means includes a plurality of fluid reservoirs and corresponding fluid passageway means for interconnecting said reservoirs in sealed fluid communication with said fluid chambers.

53. A sectionalized support arrangement as in claim 52, wherein the number of fluid chambers matches the number of fluid reservoirs, such that a respective chamber is matched with a respective reservoir.

54. A sectionalized support arrangement as in claim 52, wherein the number of fluid chambers is greater than the number of fluid reservoirs, such that plural fluid chambers are respectively matched with at least certain of the respective fluid reservoirs.

55. A sectionalized support arrangement as in claim 52, wherein the number of fluid chambers is less than the number of fluid reservoirs, such that plural fluid reservoirs are respectively matched with at least certain of the respective fluid chambers.

56. A sectionalized support arrangement as in claim 52, wherein said reservoir comprises one of a variable volume chamber for holding fluid, and a fluid sealable membrane adapted to be variably compressed by the action of elements pressing thereon, and wherein said fluid passageway means comprises a fluid port formed with each said fluid reservoir and an interconnecting conduit associated with each said port.

57. A sectionalized support arrangement as in claim 52, wherein:

said fluid reservoir means further includes a corresponding plurality of reservoir actuation means, responsive to a respective actuation force applied thereto for acting on its corresponding reservoir with a force tending to push fluid from such fluid reservoir into one of said fluid passageway means and towards its correspondingly associated fluid chamber; and wherein each of said reservoir actuation means comprises at least two members, relatively movable with respect to each other and mutually cooperative for transmitting said actuation force to its corresponding reservoir.

58. A sectionalized support arrangement as in claim 57, wherein said at least two members comprise a pair of relatively planar elements, received for one of relative planar movement parallel to each other and pivoting movement relative to each other with said reservoir received therebetween so as to receive a varying force depending on the degree of movement of said planar elements.

59. A sectionalized support arrangement as in claim 57, wherein said at least two members are integrally associated with their respective reservoir so as to form part of such reservoir, and wherein said two members comprise opposing end plates received against otherwise open end of each such reservoir for sealing same, said end plates being alternately movable in relative planar parallel movements to each other so as to variably compress such reservoir therebetween depending on the degree of parallel movement of said two members, and further wherein at least one of said end plates includes a port for fluid interconnection of such reservoir with its corresponding fluid passageway means.

60. A sectionalized support arrangement as in claim 57, wherein said reservoir actuation means comprises at least three members, relatively movable with respect to each other and with associated ones of said respective fluid chambers received between two relative pairs of such three members, such that actuation force applied to a respective pair is transmitted to its respective associated fluid chamber received therebetween.

61. A sectionalized support arrangement as in claim 60, wherein said relative pairs of members are received in stacked array for one of relative planar movement parallel to each other and respective pivoting movement relative to each other.

62. A sectionalized support arrangement as in claim 57, wherein said fluid reservoir means further includes constant force actuation means for applying said actuation force to said reservoir actuation means, said actuation force being at least a generally constant force.

63. A sectionalized support arrangement as in claim 62, wherein said constant force actuation means includes one of at least one constant force spring and another arrangement associated with said reservoir actuation means so as to apply said actuation force thereto.

64. A sectionalized support arrangement as in claim 52, wherein said fluid reservoir means further includes a corresponding plurality of constant force actuation means including a respective resilient member for imparting a force directly to each of said reservoirs tending to push fluid from said fluid reservoir into said fluid passageway means and towards at least one correspondingly associated fluid chamber.

65. A sectionalized support arrangement as in claim 52, wherein said fluid comprises one of a gas, a liquid, and a relatively viscous liquid.

66. A sectionalized support arrangement as in claim 51, wherein said predetermined arrangement includes longitudinal spacing of said chambers relative to the intended orientation of said main support body.

67. A sectionalized support arrangement as in claim 51, wherein said predetermined arrangement includes lateral spacing of said chambers relative to the intended orientation of said main support body.

68. A sectionalized support arrangement as in claim 51, wherein said predetermined arrangement includes a preselected mixture of longitudinal and lateral spacing of said chambers relative to the intended orientation of said main support body.

69. A sectionalized support arrangement as in claim 51, wherein said respective chamber internal pressures are predetermined so as to generally be the same in each chamber.

70. A sectionalized support arrangement as in claim 51, wherein said respective chamber internal pressures are predetermined so as to be different in at least some of said chambers than in other of said chambers.

71. A sectionalized support arrangement as in claim 51, wherein said predetermined chamber internal pressures relative to local absolute pressure are selected to be within a range generally of from about 0.2 PSI to about 0.5 PSI.

72. A sectionalized support arrangement as in claim 71, wherein said chamber internal pressure ranges are predetermined to be within a range of from about 0.2 PSI to about 0.3 PSI.

73. A sectionalized support arrangement as in claim 71, wherein said chamber internal pressure ranges are predetermined to be within a range of from about 0.35 PSI to about 0.45 PSI.

74. A sectionalized support arrangement as in claim 51, wherein said main support body comprises one of a mattress, a mattress overlay, and a mattress replacement.

75. A sectionalized support arrangement as in claim 51, wherein said main support body comprises a seating arrangement including one of such as for a wheelchair, a geriatric care chair, a specialized patient care chair, an ergonomic chair, and a seat in a transportation vehicle.

76. A mattress overlay for providing optimized interface pressure dispersion for a patient received thereon without use of an external power source and without requiring any electronic control system for receiving sensory feedback and operating pressure pumps or valving systems responsive thereto, said mattress overlay comprising:

a main support body for receiving a patient thereon, said body having at least four elongated air chambers arranged generally in parallel therein with each chamber having a respective air port, said body further having a resilient support layer received over said air chambers and on which a patient is received;

a plurality of air hoses respectively connected in air sealed relationship with each of said respective air ports;

a plurality of air reservoirs respectively connected in air sealed relationship with each of said respective air ports, so that at least four independently acting pressure relief devices are formed by the resulting respective grouping of an air chamber, air hose and air reservoir in air sealed relationship with each such grouping having an initially predetermined amount of air therein movable within the air sealed grouping so as to permit the establishment of air pressure equilibrium within such grouping;

at least one constant force spring respectively associated with each air reservoir;

at least four reservoir actuation means, one each associated with each respective independently acting pressure relief device, and each respectively operative for applying the potential energy of a corresponding constant force spring to its respective air reservoir so that changes in patient loading applied to each respective air chamber are automatically compensated within a predetermined range by use of the potential energy of its corresponding constant force spring, such that air pressure within such grouping is automatically maintained within a range predetermined for optimizing dispersion of patient interface pressures with said mattress overlay, without requiring sensory feedback on control systems.

77. A mattress overlay as in claim 76, wherein each of said reservoir actuation means includes a second constant force spring acting in tandem with said at least one constant force spring thereof.

78. A mattress overlay as in claim 77, wherein each tandem pair of constant force springs have a total constant force predetermined to come within a range generally of from about 2 pounds to about 6 pounds, and each air reservoir has a predetermined maximum volume capacity in a range generally of from about 50 cubic inches to about 200 cubic inches.

79. A mattress overlay as in claim 76, wherein said air reservoirs and their corresponding reservoir actuation means are all housed within said main support body.

80. A mattress overlay as in claim 76, wherein said four air reservoirs and their corresponding reservoir actuation means are generally received in the respective four corners of said main support body.

81. A mattress overlay as in claim 76, wherein said elongated air chambers are received within a protective envelope, and wherein said resilient support layer includes a foam body having differentiated surface support segments for further pressure dispersion.

82. A self-adjusting component for use with a fluid chamber in a pressure relief patient support system, comprising:

a fluid reservoir with fluid therein and having a fluid port;

fluid passageway means for interconnecting said reservoir fluid port in sealed fluid communication with the variably compressible fluid chamber of a pressure relief patient support system;

reservoir actuation means, responsive to an actuation force applied thereto for acting on said reservoir with a force tending to push fluid from said fluid reservoir into said fluid passageway means and towards a fluid chamber associated therewith; and constant force actuation means for applying a generally constant actuation force to said reservoir actuation means, so that a varying flow of fluid tending to push towards said fluid reservoir into said fluid passageway means and from a fluid chamber associated therewith due to corresponding varying patient loading applied to such patient support fluid chamber is automatically met with an opposing fluid force from said reservoir until an equilibrium fluid pressure is obtained providing a patient interface pressure coming within a predetermined range;

wherein said reservoir actuation means comprises at least two members, relatively movable with respect to each other and mutually cooperative for transmitting said actuation force to said reservoir.

83. A self-adjusting component as in claim 82, wherein said reservoir comprises a variable volume chamber for holding fluid.

84. A self-adjusting component as in claim 83, wherein said reservoir comprises a fluid sealable membrane adapted to be variably compressed by the action of elements pressing thereon.

85. A self-adjusting component as in claim 82, wherein said fluid passageway means comprises flexible tubing.

86. A self-adjusting component as in claim 82, wherein said at least two members comprise a pair of relatively planar elements.

87. A self-adjusting component as in claim 86, wherein said planar elements are received for relative planar movement parallel to each other with said reservoir received therebetween so as to receive a varying compressive force depending on the degree of parallel movement of said planar elements.

88. A self-adjusting component as in claim 87, wherein said reservoir actuation means further includes at least one guide channel with at least one of said planar elements received therein for movement therealong.

89. A self-adjusting component as in claim 86, wherein said planar elements are received for pivoting movement relative to each other with said reservoir received therebetween so as to receive a varying compressive force depending on the degree of pivoting movement of said planar elements.

90. A self-adjusting component as in claim 82, wherein said at least two members are received for axial twisting movement relative to each other with said reservoir secured therebetween so as to receive a varying torsional force depending on the degree of twisting movement of said at least two members.

91. A self-adjusting component as in claim 82, wherein said at least two members are integrally associated with said reservoir so as to form part of said reservoir, and wherein said two members comprise opposing end plates received against otherwise open ends of said reservoir for sealing same, said end plates being alternately movable in relative planar parallel movements to each other so as to variably compress said reservoir therebetween depending on the degree of parallel movement of said two members, and further wherein at least one of said end plates includes a port for fluid interconnection of said reservoir with said fluid passageway means.

92. A self-adjusting component as in claim 82, wherein said two members include one support member with said reservoir supported thereon and one movable member movable relative to said support member for engaging said reservoir between said two members so as to transmit said actuation force to said reservoir.

93. A self-adjusting component as in claim 92, wherein said support member comprises a generally planar member with opposing ends of said reservoir secured thereon and with said fluid port formed relatively adjacent one of such reservoir ends and in fluid communication with said fluid passageway means, and further wherein said movable member comprises a generally cylindrical member mounted intermediate said reservoir opposing ends for movement therebetween in engagement with said reservoir such that fluid in said reservoir may be forced towards said reservoir fluid port by movement of said movable member towards said fluid port.

94. A self-adjusting component as in claim 82, further including a tandem arrangement of two of said self-adjusting components.

95. A self-adjusting component as in claim 94, wherein said tandem arrangement includes relative pairs of said at least two members of said reservoir actuation means received in stacked array for one of relative planar movement parallel to each other and for respective pivoting movement relative to each other.

96. A self-adjusting component as in claim 82, wherein said fluid includes one of a gas, a liquid, and a relatively viscous fluid.

97. A self-adjusting component as in claim 96, wherein said gas is air.

98. A self-adjusting component as in claim 82, further including a plurality of said self-adjusting components incorporated into a system having a plurality of fluid chambers associated therewith.

99. A self-adjusting component for use with a fluid chamber in a pressure relief patient support system, comprising:

a fluid reservoir with fluid therein and having a fluid port;

fluid passageway means for interconnecting said reservoir fluid port in sealed fluid communication with the variably compressible fluid chamber of a pressure relief patient support system;

reservoir actuation means, responsive to an actuation force applied thereto for acting on said reservoir with a force tending to push fluid from said fluid reservoir into said fluid passageway means and towards a fluid chamber associated therewith; and constant force actuation means for applying a generally constant actuation force to said reservoir actuation means, so that a varying flow of fluid tending to push towards said fluid reservoir into said fluid passageway means and from a fluid chamber associated therewith due to corresponding varying patient loading applied to such patient support fluid chamber is automatically met with an opposing fluid force from said reservoir until an equilibrium fluid pressure is obtained providing a patient interface pressure coming within a predetermined range;

wherein said constant force actuation means includes at least one constant force spring associated with said reservoir actuation means so as to apply said actuation force thereto.

100. A self-adjusting component as in claim 99, wherein said constant force actuation means further includes a flexible webbing interconnecting between said at least one constant force spring and said reservoir actuation means.

101. A self-adjusting component as in claim 99, wherein said constant force actuation means further includes a second constant force spring operative in tandem with said at least one constant force spring for applying said actuation force to said reservoir actuation means.

102. A self-adjusting component for use with a fluid chamber in a pressure relief patient support system, comprising:

a fluid reservoir with fluid therein and having a fluid port;

fluid passageway means for interconnecting said reservoir fluid port in sealed fluid communication with the fluid chamber of a pressure relief patient support system;

reservoir actuation means, responsive to an actuation force applied thereto for acting on said reservoir with a force tending to push fluid from said fluid reservoir into said fluid passageway means and towards a fluid chamber associated therewith; and constant force actuation means for applying a generally constant actuation force to said reservoir actuation means, so that a varying flow of fluid tending to push towards said fluid reservoir into said fluid passageway means and from a fluid chamber associated therewith due to corresponding varying patient loading applied to such patient support fluid chamber is automatically met with an opposing fluid force from said reservoir until an equilibrium fluid pressure is obtained providing a patient interface pressure coming within a predetermined range;

wherein said constant force actuation means includes a counterweight arrangement associated with said reservoir actuation means so as to apply said actuation force thereto.

103. A self-adjusting pressure relief patient support methodology, comprising the steps of:

providing a main support body for receiving a patient thereon, and having at least one adjustable fluid support bladder with fluid therein; and providing a fluid reservoir in fluid communication with said fluid support bladder and with constant force applied thereto using potential energy, resiliently actuated for automatically adjusting said bladder so as to maintain a generally constant predetermined internal pressure in said bladder responsive to changing patient loading on said main support body;

wherein said main body includes a plurality of adjustable support bladders with fluid therein, and comprises one of a mattress, a mattress overlay, a mattress substitute and a seating arrangement, with said bladders arranged in a predetermined support arrangement corresponding with the form and intended use of said main body.

104. A methodology as in claim 103, wherein said fluid reservoir comprises a variable volume chamber for holding fluid and having a fluid port, and wherein said methodology further includes providing fluid passageway means for interconnecting said reservoir port in sealed fluid communication with said support bladder, and wherein said support bladder comprises a fluid sealable membrane adapted to be variably compressed by the interaction of elements therewith.

105. A methodology as in claim 104, wherein:

said fluid passageway means comprises flexible tubing; and said methodology further includes providing reservoir actuation means, responsive to an actuation force applied thereto for acting on said reservoir with a force tending to push fluid from said fluid reservoir into said fluid passageway means and towards said support bladder.

106. A methodology as in claim 105, wherein said reservoir actuation means comprises at least two relatively planar elements, relatively movable with respect to each other and mutually cooperative for transmitting said actuation force to said reservoir.

107. A methodology as in claim 106, wherein said planar elements are received for one of relative planar movement parallel to each other, pivoting movement relative to each other, and axial twisting movement relative to each other, with said reservoir received therebetween so as to receive a varying force thereto depending on the degree of movement of said planar elements.

108. A methodology as in claim 106, wherein:

said at least two elements are integrally associated with said reservoir so as to form part of said reservoir; and said two elements comprise opposing end plates received against otherwise open ends of said reservoir for sealing same, said end plates being alternately movable in relative planar parallel movements to each other so as to variably compress said reservoir therebetween depending on the degree of parallel movement of said two elements; and further wherein at least one of said end plates includes a port for fluid interconnection of said reservoir with said fluid passageway means.

109. A methodology as in claim 106, wherein:

said two elements include one support member with said reservoir supported thereon and one movable member movable relative to said support member for engaging said reservoir between said two elements so as to transmit said actuation force to said reservoir;

said support member comprises a generally planar member with opposing ends of said reservoir secured thereon and with a fluid port formed relatively adjacent one of such reservoir ends and in fluid communication with said fluid passageway means; and further wherein said movable member comprises a generally cylindrical member mounted intermediate said reservoir opposing ends for movement therebetween in engagement with said reservoir such that fluid in said reservoir may be forced towards said reservoir fluid port by movement of said movable member towards said reservoir fluid port.

110. A methodology as in claim 104, further including the step of using a resilient member for imparting a force directly to said reservoir tending to push fluid from said fluid reservoir into said fluid passageway means and towards said support bladder, said resilient member comprising one of at least one elastic band received about a portion of said reservoir and a resilient clip with opposing legs placed in contact with at least a portion of said reservoir so as to impart a squeezing force thereto.

111. A methodology as in claim 104, wherein said main support body includes a plurality of fluid support bladders with fluid therein and commonly interconnected with said fluid reservoir by said fluid passageway means.

112. A methodology as in claim 104, wherein:

said main support body includes a plurality of fluid support bladders with fluid therein; and said methodology further includes the step of providing a corresponding plurality of reservoirs respectively interconnected with said plurality of bladders by said fluid passageway means, and further includes a corresponding plurality of reservoir actuation means, responsive to an actuation force applied thereto for independently acting on a corresponding one of said reservoirs with a force tending to push fluid from such fluid reservoir into said fluid passageway mean and towards a support bladder respectively interconnected with such reservoir.

113. A methodology as in claim 103, further including the steps of:

providing said main support body with at least two respective adjustable fluid support bladders with fluid therein; and providing at least two respective corresponding fluid reservoirs and corresponding respective fluid passageway means for respectively interconnecting said respective reservoirs in sealed fluid communication with corresponding respective support bladders.

114. A methodology as in claim 113, wherein:

said fluid reservoirs comprise respective fluid sealable membranes adapted to be variably compressed by the action of elements pressing thereon, and having respective fluid ports therein for connection with said fluid passageway means;

said fluid passageway means comprise respective interconnecting conduits respectively associated with said respective fluid ports and said corresponding respective support bladders; and wherein said methodology further includes the step of providing reservoir actuation means, responsive to an actuation force applied thereto for acting on said reservoir with a force tending to push fluid from said fluid reservoir into said fluid passageway means and towards said support bladder, and wherein said reservoir actuation means comprises at least three members, relatively movable with respect to each other and with associated ones of said respective support bladders received between two relative pairs of such three members, such that actuation force applied to a respective pair is transmitted to its respective associated support bladder received therebetween.

115. A methodology as in claim 114, wherein said relative pairs of members are received in stacked array for one of relative planar movement parallel to each other and respective pivoting movement relative to each other.

116. A methodology as in claim 103, wherein said fluid comprises one of a gas, a liquid, and a relatively viscous liquid.

117. A methodology as in claim 103, further including the step of providing one or more fluid reservoirs, and selectively operatively associating each such reservoir with a selected number of said support bladders.

118. A methodology as in claim 117, wherein said selected number is from one to four, inclusive.

119. A methodology as in claim 117, further including the step of selecting the amount of fluid originally introduced into a fluid reservoir and its corresponding operatively associated selected number of support bladders, and selecting the fluid capacity of each reservoir, together with a predetermined selected value for said constant force, such that the resulting bladder adjustability will accommodate patient loading changes on said main body of up to generally 300 pounds while maintaining the internal bladder pressure relative to local absolute pressure to a generally constant pressure within a range of from about 0.2 PSI to about 0.5 PSI.

120. A methodology as in claim 119, wherein four support bladders are provided with a corresponding respectively associated number of four reservoirs, each reservoir having a maximum adjustment capacity within a range of from about 50 cubic inches to about 200 cubic inches.

121. A self-adjusting pressure relief patient support methodology, comprising the steps of:

providing a main support body for receiving a patient thereon, and having at least one adjustable fluid support bladder with fluid therein; and providing a fluid reservoir in fluid communication with said fluid support bladder and with constant force applied thereto using potential energy, for automatically adjusting said bladder so as to maintain a generally constant predetermined internal pressure in said bladder responsive to changing patient loading on said main support body;

wherein said fluid reservoir comprises a variable volume chamber for holding fluid and having a fluid port, and wherein said methodology further includes providing fluid passageway means for interconnecting said reservoir port in sealed fluid communication with said support bladder;

said fluid passageway means comprises flexible tubing; and said methodology further includes providing reservoir actuation means, responsive to an actuation force applied thereto for acting on said reservoir with a force tending to push fluid from said fluid reservoir into said fluid passageway means and towards said support bladder; and further including the step of using one of at least one constant force spring and a counterweight arrangement associated with said reservoir actuation means so as to apply said actuation force thereto.

122. A pressure relief support methology for a mattress for automatically optimizing pressure dispersion for a person received thereon, without requiring sensory feedback or pump control systems, said methodology comprising the steps of:

providing a plurality of elongated fluid chambers with fluid therein, disposed generally in parallel and having respective individual fluid ports defining a fluid passageway between the interior and exterior of each respective chamber;

providing a main support body for receiving and generally maintaining said plurality of fluid chambers in a predetermined arrangement relative to each other;

respectively interconnecting a plurality of fluid conduits in fluid sealed relationship with each of said chamber fluid ports for permitting fluid to be controllably transmitted alternately into and out of each respective fluid chamber; and providing a fluid reservoir in fluid communication with said plurality of fluid conduits and with constant force applied thereto using potential energy, resiliently actuated for automatically adjusting the amount of fluid within each of said fluid chambers without requiring use of any sensory feedback or pump control systems, so as to maintain generally constant predetermined fluid pressure within the interiors of said fluid chambers responsive to respective loading changes on said plurality of fluid chambers.

123. A pressure relief support methodology for a mattress as in claim 122, wherein said fluid reservoir includes at least one variable volume fluid reservoir and a fluid port therein connected with at least one of said fluid conduits for interconnecting said reservoir in sealed fluid communication with selected ones of said elongated fluid chambers.

124. A pressure relief support methodology for a mattress as in claim 123, further including the step of providing reservoir actuation means, responsive to an actuation force applied thereto for acting on said reservoir with a force tending to push fluid from said fluid reservoir into a corresponding fluid conduit and towards a corresponding fluid chamber, said reservoir actuation means comprising at least two members, relatively movable with respect to each other and mutually cooperative for transmitting said actuation force to said reservoir.

125. A pressure relief support methodology for a mattress as in claim 124, wherein said at least two members comprise a pair of relatively planar elements, received for relative planar movement parallel to each other with said reservoir received therebetween so as to receive a varying compressive force depending on the degree of parallel movement of said planar elements.

126. A pressure relief support methodology for a mattress as in claim 125, wherein said reservoir actuation means further includes a pair of relatively low friction slide channels with at least one of said planar elements received therein for guided movement therealong.

127. A pressure relief support methodology for a mattress as in claim 124, wherein said two members are received for one of pivoting movement relative to each other and axial twisting movement relative to each other with said reservoir received therebetween so as to receive a varying force depending on the degree of movement of said two members.

128. A pressure relief support methodology for a mattress as in claim 124, wherein said two members comprise opposing end plates received against otherwise open ends of said reservoir for sealing same, said end plates being alternately movable in relative planar parallel movements to each other so as to variably compress said reservoir therebetween depending on the degree of parallel movement of said two members, and further wherein at least one of said end plates includes a port for fluid interconnection of said reservoir with said fluid conduit.

129. A pressure relief support methodology for a mattress as in claim 124, wherein one of said two members comprises a generally planar support member with opposing ends of said reservoir received thereon and with a fluid port formed relatively adjacent one of such reservoir ends and in fluid communication with said fluid conduit, and further wherein the other of said two members comprises a generally cylindrical movable member mounted intermediate said reservoir opposing ends for movement therebetween in engagement with said reservoir such that fluid in said reservoir may be forced towards said reservoir fluid port by movement of said movable member towards said reservoir fluid port.

130. A pressure relief support methodology for a mattress as in claim 124, further including the step of providing said fluid reservoir with constant force actuation means for applying said actuation force to said reservoir actuation means, said actuation force being at least a generally constant force.

131. A pressure relief support methodology for a mattress as in claim 130, including the further step of providing said constant force actuation means with at least one constant force spring associated with said reservoir actuation means so as to apply said actuation force thereto.

132. A pressure relief support methodology for a mattress as in claim 131, including the further step of providing said constant force actuation means with a second constant force spring operative in tandem with said at least one constant force spring for applying said actuation force to said reservoir actuation means.

133. A pressure relief support methodology for a mattress as in claim 122, further including the steps of:

providing said main support body with at least two respective adjustable elongated fluid chambers with fluid therein, and with a resilient foam body at least partially enclosing and covering said chambers so as to form a user receiving surface thereover; and providing said constant force fluid reservoir means with at least two respective corresponding fluid reservoirs associated with corresponding respective fluid conduits for respectively interconnecting said respective reservoirs in sealed fluid communication with corresponding respective elongated fluid chambers.

134. A pressure relief support methodology for a mattress as in claim 132, further including the steps of:

housing in said main support body four of said elongated fluid chambers disposed therein in parallel and directed longitudinally along said main support body intended for generally longitudinal alignment with a user received thereon; and providing said constant force fluid reservoir means with four corresponding fluid reservoirs associated respectively with said four fluid chambers through a corresponding number of said fluid conduits.

135. A pressure relief support methodology for a mattress as in claim 131, wherein said four fluid reservoirs and corresponding automatic adjustment features thereof of said constant force fluid reservoir means are further housed generally within said main support body.

136. A pressure relief support methodology for a mattress as in claim 135, further including the steps of providing said reservoirs with a predetermined maximum fluid volume generally in a range of from about 100 cubic inches to about 150 cubic inches, and applying a predetermined constant force to each such reservoir generally in a range of from about 2 pounds to about 6 pounds, and determining the initial amount of fluid in each respective elongated fluid chamber such that the resulting constant predetermined fluid pressure within said interiors of said fluid chambers relative to local absolute pressure is generally within a range of from about 0.2 PSI to about 0.5 PSI.

137. A sectionalized support methodology for use with multiple independently acting support sections, comprising the steps of; and providing a main support body having a predetermined arrangement of independently adjustable fluid chambers therein with fluid in said chambers, and with the shape and size of each chamber selected so as to define a corresponding desired independently acting support section; and providing a plurality of fluid reservoirs, each being respectively in fluid communication with a respective one of said fluid chambers and having constant force applied thereto using potential energy, resilently actuated for automatically adjusting such respective one chamber so as to independently maintain a generally constant predetermined internal pressure in such respective one chamber responsive to changing patient loading on said main support body.

138. A sectionalized support methodology as in claim 137, further including the step of providing a plurality of fluid reservoirs and corresponding fluid passageway means for interconnecting said reservoirs in sealed fluid communication with said fluid chambers.

139. A sectionalized support methodology as in claim 138, wherein the number of fluid chambers matches the number of fluid reservoirs, such that a respective chamber is matched with a respective reservoir.

140. A sectionalized support methodology as in claim 138, wherein the number of fluid chambers is greater than the number of fluid reservoirs, such that plural fluid chambers are respectively matched with at least certain of the respective fluid reservoirs.

141. A sectionalized support methodology as in claim 138, wherein the number of fluid chambers is less than the number of fluid reservoirs, such that plural fluid reservoirs are respectively matched with at least certain of the respective fluid chambers.

142. A sectionalized support methodology as in claim 138, wherein:

said methodology further includes the step of providing a corresponding plurality of reservoir actuation means, responsive to a respective actuation force applied thereto for acting on its corresponding reservoir with a force tending to push fluid from such fluid reservoir into one of said fluid passageway means and towards its correspondingly associated fluid chamber; and wherein each of said reservoir actuation means comprises at least two members, relatively movable with respect to each other and mutually cooperative for transmitting said actuation force to its corresponding reservoir.

143. A sectionalized support methodology as in claim 142, wherein said at least two members comprise a pair of relatively planar elements, received for one of relative planar movement parallel to each other and pivoting movement relative to each other with said reservoir received therebetween so as to receive a varying force depending on the degree of movement of said planar elements.

144. A sectionalized support methodology as in claim 142, further including the step of providing constant force actuation means for applying said actuation force to said reservoir actuation means, said actuation force being at least a generally constant force, wherein said constant force actuation means includes one of at least one constant force spring and another arrangement associated with said reservoir actuation means so as to apply said actuation force thereto.

145. A sectionalized support methodology as in claim 138, wherein said fluid reservoir means further includes a corresponding plurality of constant force actuation means including a respective resilient member for imparting a force directly to each of said reservoirs tending to push fluid from said fluid reservoir into said fluid passageway means and towards at least one correspondingly associated fluid chamber.

146. A sectionalized support methodology as in claim 138, wherein said fluid comprises one of a gas, a liquid, and a relatively viscous liquid.

147. A sectionalized support methodology as in claim 138, further including the step of selecting the amount of fluid originally introduced into a fluid reservoir and its corresponding operatively associated selected number of fluid chambers and selecting the fluid capacity of each reservoir, together with a predetermined selected value for said constant force, such that the resulting fluid chamber adjustability will accommodate patient loading changes on said main body of up to generally 300 pounds while maintaining the internal chamber pressure relative to local absolute pressure to a generally constant pressure within a range of from about 0.2 PSI to about 0.5 PSI.

148. A sectionalized support methodology as in claim 137, wherein said predetermined arrangement includes one of longitudinal, lateral, angled, and mixed spacing of said chambers relative to the intended orientation of said main support body.

149. A sectionalized support methodology as in claim 137, wherein said respective chamber internal pressures are predetermined so as to generally be the same in each chamber.

150. A sectionalized support methodo wherein in claim 137, wherein said respective chamber internal pressures are predetermined so as to be different in at least some of said chambers than in other of said chambers.

151. A sectionalized support methodology as in claim 137, wherein said predetermined chamber internal pressures relative to local absolute pressure are selected to be within a range generally of from about 0.2 PSI to about 0.5 PSI.

152. A sectionalized support methodology as in claim 151, wherein said chamber internal pressure ranges are predetermined to be within a range of from about 0.2 PSI to about 0.3 PSI.

153. A sectionalized support methodology as in claim 151, wherein said chamber internal pressure ranges are predetermined to be within a range of from about 0.35 PSI to about 0.45 PSI.

154. A sectionalized support methodology as in claim 137, wherein said main support body comprises one of a mattress, a mattress overlay, and a mattress replacement.

155. A sectionalized support methodology as in claim 137, wherein said main support body comprises a seating arrangement including one of such as for a wheelchair, a geriatric care chair, a specialized patient care chair, an ergonomic chair, and a transportation vehicle seat.

* * * * *